US010441067B2

(12) United States Patent
Tomuta et al.

(10) Patent No.: US 10,441,067 B2
(45) Date of Patent: Oct. 15, 2019

(54) BRUSHES FOR DELIVERING GLUTINOUS SUBSTANCE TO WORKPIECE FROM END-EFFECTOR

(71) Applicant: The Boeing Company, Chicago, IL (US)

(72) Inventors: Raul Tomuta, Stanton, CA (US); Richard P. Topf, Orange, CA (US); Martin Guirguis, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/143,140

(22) Filed: Apr. 29, 2016

(65) Prior Publication Data

US 2017/0105512 A1 Apr. 20, 2017

Related U.S. Application Data

(60) Provisional application No. 62/242,216, filed on Oct. 15, 2015.

(51) Int. Cl.

| | |
|---|---|
| ***A46B 7/08*** | (2006.01) |
| ***A46B 11/00*** | (2006.01) |
| ***A46B 9/02*** | (2006.01) |
| ***A46B 11/06*** | (2006.01) |
| ***A46B 13/00*** | (2006.01) |

(Continued)

(52) U.S. Cl.

CPC ..... *A46B 11/0072* (2013.01); *A46B 7/08* (2013.01); *A46B 9/025* (2013.01); *A46B 11/0006* (2013.01); *A46B 11/06* (2013.01); *A46B 11/063* (2013.01); *A46B 13/001* (2013.01);

(Continued)

(58) Field of Classification Search

None

See application file for complete search history.

(56) References Cited

U.S. PATENT DOCUMENTS

| | | | |
|---|---|---|---|
| 1,199,780 | A | 10/1916 | Goodrich |
| 1,314,441 | A | 8/1919 | Stensrud |

(Continued)

FOREIGN PATENT DOCUMENTS

| | | |
|---|---|---|
| CH | 647709 | 2/1985 |
| CN | 104415878 | 3/2015 |

(Continued)

OTHER PUBLICATIONS

Extended European Search Report for EP Application No. 16193053.2 dated Mar. 2, 2017.

(Continued)

*Primary Examiner* — Charles Capozzi

(74) *Attorney, Agent, or Firm* — Kunzler Bean & Adamson

(57) ABSTRACT

A brush for delivering a glutinous substance to a workpiece from an end-effector is disclosed. The brush comprises a body, having a rotational axis and comprising a first channel that comprises an inlet and a first outlet. The inlet is coaxial with the rotational axis and the first outlet is offset from the rotational axis. The brush also comprises tufts, extending from the body and each comprising at least one bristle and a tip. The brush further comprises a first tube, communicatively coupled with the first outlet of the first channel of the body.

52 Claims, 13 Drawing Sheets

(51) Int. Cl.
*A46B 13/04* (2006.01)
*B05D 1/28* (2006.01)

(52) U.S. Cl.
CPC ..... *A46B 13/008* (2013.01); *A46B 13/04* (2013.01); *B05D 1/28* (2013.01); *A46B 2200/20* (2013.01)

(56) References Cited

U.S. PATENT DOCUMENTS

| | | | | | |
|---|---|---|---|---|---|
| 1,330,001 | A * | 2/1920 | Swanson | 118/256 | |
| 1,465,856 | A * | 8/1923 | Marsh | A46B 11/063 | 401/287 |
| 1,475,079 | A | 11/1923 | William | | |
| 1,979,240 | A | 11/1934 | Adelmann | | |
| 2,064,318 | A * | 12/1936 | Platt | A46B 11/0013 | 401/277 |
| 2,227,792 | A * | 1/1941 | Norton, Jr. | A46B 11/063 | 15/176.2 |
| 2,321,961 | A * | 6/1943 | Wilde | A21B 3/16 | 118/259 |
| 2,590,977 | A * | 4/1952 | Kay | A47L 23/10 | 15/114 |
| 2,747,217 | A * | 5/1956 | Stahl | A47L 9/06 | 15/160 |
| 2,859,564 | A | 11/1958 | Farmer et al. | | |
| 3,425,080 | A | 2/1969 | Dolitzsch | | |
| 3,860,987 | A * | 1/1975 | Bolli | B63B 59/00 | 15/29 |
| 3,872,533 | A | 3/1975 | Proffit | | |
| 3,994,041 | A | 11/1976 | Barber | | |
| 4,570,282 | A * | 2/1986 | Kaufman | A46B 9/045 | 15/167.1 |
| 4,881,289 | A * | 11/1989 | Tsuyoshi | A46B 3/12 | 118/697 |
| 5,027,463 | A * | 7/1991 | Daub | A46B 9/045 | 15/167.1 |
| 5,171,095 | A | 12/1992 | Davies et al. | | |
| 6,409,103 | B1 * | 6/2002 | Norville | B05B 11/0005 | 239/587.1 |
| 6,722,956 | B2 | 4/2004 | Okuyama et al. | | |
| 7,386,911 | B2 | 6/2008 | Stoll | | |
| 8,651,046 | B1 | 2/2014 | Davancens et al. | | |
| 2004/0255410 | A1 * | 12/2004 | Schonewille | A47L 13/26 | 15/29 |
| 2005/0003077 | A1 * | 1/2005 | Kamata | H01B 13/345 | 427/117 |
| 2007/0026773 | A1 * | 2/2007 | Vogel | B24B 9/00 | 451/469 |
| 2007/0050938 | A1 | 3/2007 | Rosenzweig | | |
| 2009/0080964 | A1 | 3/2009 | Castellana | | |
| 2015/0064357 | A1 | 3/2015 | Tomuta et al. | | |
| 2017/0105513 | A1 | 4/2017 | Davancens et al. | | |
| 2017/0105514 | A1 | 4/2017 | Tomuta et al. | | |
| 2017/0106538 | A1 | 4/2017 | Tomuta et al. | | |

FOREIGN PATENT DOCUMENTS

| | | |
|---|---|---|
| DE | 3320598 | 12/1984 |
| DE | 3634018 | 10/1986 |
| DE | 102006050722 | 4/2008 |
| DE | 102008014358 | 10/2009 |
| DE | 102008039804 | 2/2010 |
| EP | 2842457 | 3/2015 |
| JP | 2001353611 | 12/2001 |

OTHER PUBLICATIONS

Extended European Search Report for EP Application No. 16193055.7 dated Mar. 6, 2017.

Aerospace Dispensing Systems, Fori's New Aerospace Division Blog dated Oct. 3, 2013, http://fori-aerospace.blogspot.com/2013/10/aerospace-dispensing-systems.html, Fori Automation, Inc., accessed Jun. 2, 2016.

Notice of Allowance for U.S. Appl. No. 15/143,235 dated Nov. 29, 2017.

Office Action for Chinese Patent Application No. 201610885794.3 dated May 14, 2019.

* cited by examiner (CONT.)

316

THE BODY (202) OF THE BRUSH (200) FURTHER COMPRISES A SECOND CHANNEL (211), COMPRISING THE INLET (209) AND A SECOND OUTLET (282), THE SECOND OUTLET (282) IS OFFSET FROM THE ROTATIONAL AXIS (238); THE BRUSH (200) FURTHER COMPRISES A SECOND TUBE (212), COMMUNICATIVELY COUPLED WITH THE SECOND OUTLET (282) OF THE SECOND CHANNEL (211) OF THE BODY (202), THE SECOND TUBE (212) COMPRISES A FIFTH OUTLET (273), THE METHOD (300) FURTHER COMPRISES, WHILE ROTATING THE BRUSH (200) RELATIVE TO THE WORKPIECE (170) ABOUT THE ROTATIONAL AXIS (238), CAUSING THE END-EFFECTOR (102) TO URGE THE GLUTINOUS SUBSTANCE (168) THROUGH THE SECOND CHANNEL (211) OF THE BODY (202) OF THE BRUSH (200) FROM THE INLET (209) OF THE SECOND CHANNEL (211) TO THE SECOND OUTLET (282) OF THE SECOND CHANNEL (211) AND THROUGH THE SECOND TUBE (212), INTO CONTACT WITH THE TUFTS (222), AND WHEN THE ROTATIONAL AXIS (238) OF THE BODY (202) OF THE BRUSH (200) IS COLLINEAR WITH THE CENTRAL AXIS (239) OF THE FASTENER (230) AND THE GLUTINOUS SUBSTANCE (168), IN CONTACT WITH THE TUFTS (222), IS BEING DELIVERED AT LEAST ONTO THE LATERAL SURFACE (233) OF THE FASTENER (230), THE SECOND TUBE (212) IS ALIGNED WITH THE LATERAL SURFACE (233) OF THE HEAD (232) OF THE FASTENER (230) IN A DIRECTION ALONG THE ROTATIONAL AXIS (238)

318

WHEN THE ROTATIONAL AXIS (238) OF THE BODY (202) OF THE BRUSH (200) IS COLLINEAR WITH THE CENTRAL AXIS (239) OF THE FASTENER (230) AND THE GLUTINOUS SUBSTANCE (168), IN CONTACT WITH THE TUFTS (222), IS BEING DELIVERED AT LEAST ONTO THE LATERAL SURFACE (233) OF THE FASTENER (230), THE FIFTH OUTLET (273) OF THE SECOND TUBE (212) FACES AN INTERSECTION OF THE LATERAL SURFACE (233) OF THE HEAD (232) OF THE FASTENER (230) AND THE END SURFACE (235) OF THE HEAD (232) OF THE FASTENER (230)

320

A PLANE CO-PLANAR WITH THE END SURFACE (235) OF THE HEAD (232) THE FASTENER (230) INTERSECTS THE FIFTH OUTLET (273) OF THE SECOND TUBE (212)

322

WHEN THE ROTATIONAL AXIS (238) OF THE BODY (202) OF THE BRUSH (200) IS COLLINEAR WITH THE CENTRAL AXIS (239) OF THE FASTENER (230) AND THE GLUTINOUS SUBSTANCE (168), IN CONTACT WITH THE TUFTS (222), IS BEING DELIVERED AT LEAST ONTO THE LATERAL SURFACE (233) OF THE FASTENER (230), THE FIFTH OUTLET (273) OF THE SECOND TUBE (212) IS OBLIQUE RELATIVE TO THE SURFACE (237) OF THE WORKPIECE (170), THE LATERAL SURFACE (233) OF THE HEAD (232) OF THE FASTENER (230), AND THE END SURFACE (235) OF THE HEAD (232) OF THE FASTENER (230)

(CONT.)

*FIG. 10B*

(CONT.)

324

THE BODY (202) OF THE BRUSH (200) FURTHER COMPRISES A THIRD CHANNEL (213), COMPRISING THE INLET (209) AND A THIRD OUTLET (284), THE THIRD OUTLET (284) IS OFFSET FROM THE ROTATIONAL AXIS (238), THE BRUSH (200) FURTHER COMPRISES A THIRD TUBE (214), COMMUNICATIVELY COUPLED WITH THE THIRD OUTLET (284) OF THE THIRD CHANNEL (213) OF THE BODY (202), THE THIRD TUBE (214) COMPRISES A SIXTH OUTLET (275), THE METHOD (300) FURTHER COMPRISES, WHILE ROTATING THE BRUSH (200) RELATIVE TO THE WORKPIECE (170) ABOUT THE ROTATIONAL AXIS (238), CAUSING THE END-EFFECTOR (102) TO URGE THE GLUTINOUS SUBSTANCE (168) THROUGH THE THIRD CHANNEL (213) OF THE BODY (202) OF THE BRUSH (200) FROM THE INLET (209) OF THE THIRD CHANNEL (213) TO THE THIRD OUTLET (284) OF THE THIRD CHANNEL (213) AND THROUGH THE THIRD TUBE (214), INTO CONTACT WITH THE TUFTS (222), AND WHEN THE ROTATIONAL AXIS (238) OF THE BODY (202) OF THE BRUSH (200) IS COLLINEAR WITH THE CENTRAL AXIS (239) OF THE FASTENER (230) AND THE GLUTINOUS SUBSTANCE (168), IN CONTACT WITH THE TUFTS (222), IS BEING DELIVERED AT LEAST ONTO THE END SURFACE (235) OF THE FASTENER (230), THE THIRD TUBE (214) OF THE BRUSH (200) IS POSITIONED BETWEEN THE CENTRAL AXIS (239) OF THE FASTENER (230) AND THE LATERAL SURFACE (233) OF THE HEAD (232) OF THE FASTENER (230).

326

WHEN THE ROTATIONAL AXIS (238) OF THE BODY (202) OF THE BRUSH (200) IS COLLINEAR WITH THE CENTRAL AXIS (239) OF THE FASTENER (230) AND THE GLUTINOUS SUBSTANCE (168), IN CONTACT WITH THE TUFTS (222), IS BEING DELIVERED AT LEAST ONTO THE END SURFACE (235) OF THE FASTENER (230), THE SIXTH OUTLET (275) OF THE THIRD TUBE (214) FACES THE END SURFACE (235) OF THE HEAD (232) OF THE FASTENER (230)

328

WHEN THE ROTATIONAL AXIS (238) OF THE BODY (202) OF THE BRUSH (200) IS COLLINEAR WITH THE CENTRAL AXIS (239) OF THE FASTENER (230) AND THE GLUTINOUS SUBSTANCE (168), IN CONTACT WITH THE TUFTS (222), IS BEING DELIVERED AT LEAST ONTO THE END SURFACE (235) OF THE FASTENER (230), THE SIXTH OUTLET (273) OF THE THIRD TUBE (214) IS PARALLEL WITH THE END SURFACE (235) OF THE HEAD (232) OF THE FASTENER (230)

*FIG. 10C*

BRUSHES FOR DELIVERING GLUTINOUS SUBSTANCE TO WORKPIECE FROM END-EFFECTOR

BACKGROUND

It is commonplace to apply glutinous substances, such as sealants, adhesives, and fillers, to surfaces of structures or other objects for purposes of sealing, corrosion resistance, and/or fixation, among others. However, surface application of glutinous substances in an efficient, predictable, and uniform manner using manual techniques is difficult and time consuming.

SUMMARY

Accordingly, apparatuses and methods, intended to address at least the above-identified concerns, would find utility.

The following is a non-exhaustive list of examples, which may or may not be claimed, of the subject matter according to the present disclosure.

One example of the subject matter according to the present disclosure relates to a brush for delivering a glutinous substance to a workpiece from an end-effector. The brush comprises a body, having a rotational axis and comprising a first channel that comprises an inlet and a first outlet. The inlet is coaxial with the rotational axis and the first outlet is offset from the rotational axis. Additionally, the brush comprises tufts, extending from the body and each comprising a tip and at least one bristle. The brush further comprises a first tube, communicatively coupled with the first outlet of the first channel of the body.

Another example of the subject matter according to the present disclosure relates to a method of delivering a glutinous substance to a workpiece from an end-effector. The workpiece comprises a surface and a fastener, having a head. The head of the fastener extends from the surface of the workpiece and comprises a lateral surface and an end surface. The method comprises using the end-effector to rotate a brush relative to the workpiece about a rotational axis of a body of the brush. The body of the brush comprises a first channel that comprises an inlet and a first outlet. The inlet is coaxial with the rotational axis and the first outlet is offset from the rotational axis. The body of the brush further comprises tufts, extending from the body and each comprising a tip and at least one bristle. The brush comprises a first tube, communicatively coupled with the first outlet of the first channel of the body. The method also comprises, while rotating the brush relative to the workpiece about the rotational axis of the body, causing the end-effector to urge the glutinous substance through the first channel of the body of the brush from the inlet of the first channel to the first outlet of the first channel and through the first tube, into contact with the tufts. Additionally, the method comprises, while urging the glutinous substance into contact with the tufts, using the end-effector to position the brush relative to the workpiece such that the rotational axis of the body of the brush is collinear with a central axis of the fastener and the glutinous substance, in contact with the tufts, is delivered onto the surface of the workpiece and the fastener.

BRIEF DESCRIPTION OF THE DRAWINGS

Figure 1:
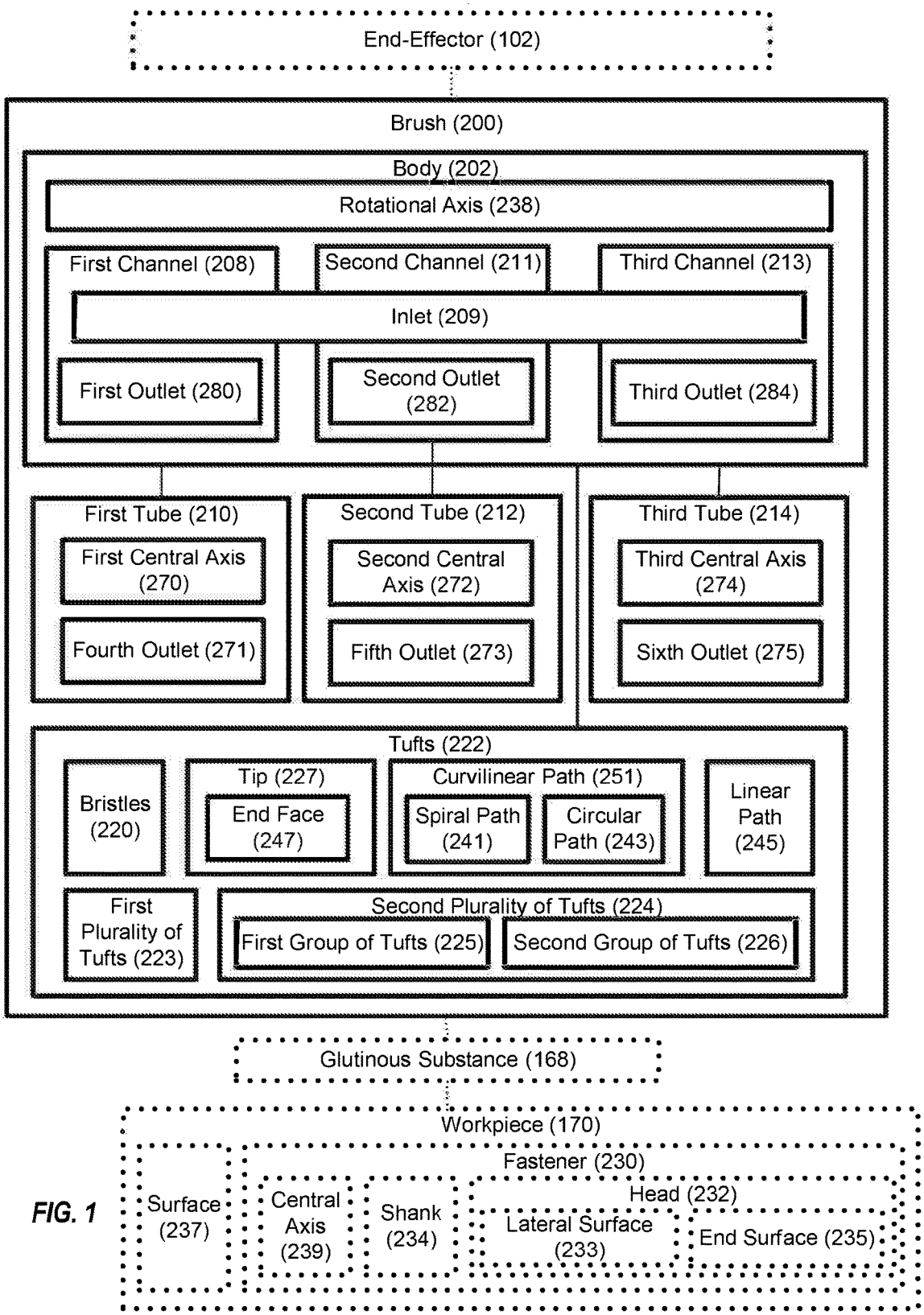
Figure 4:
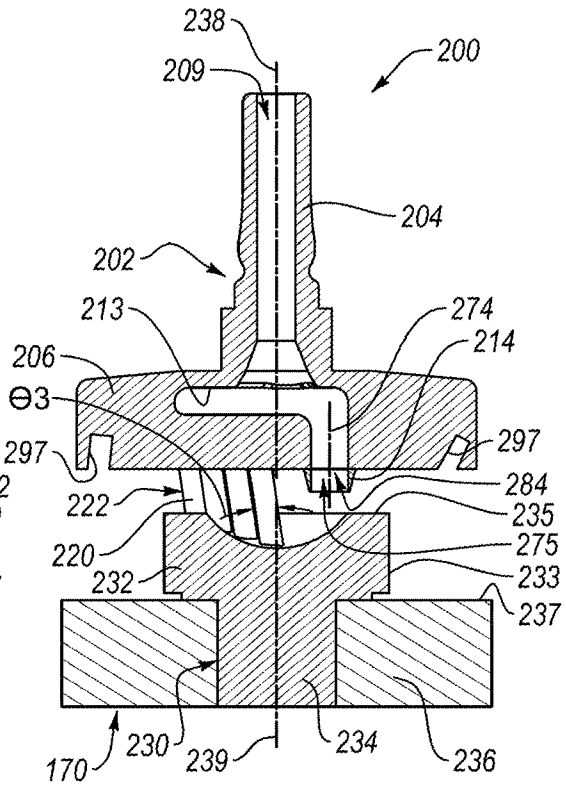
Figure 3:
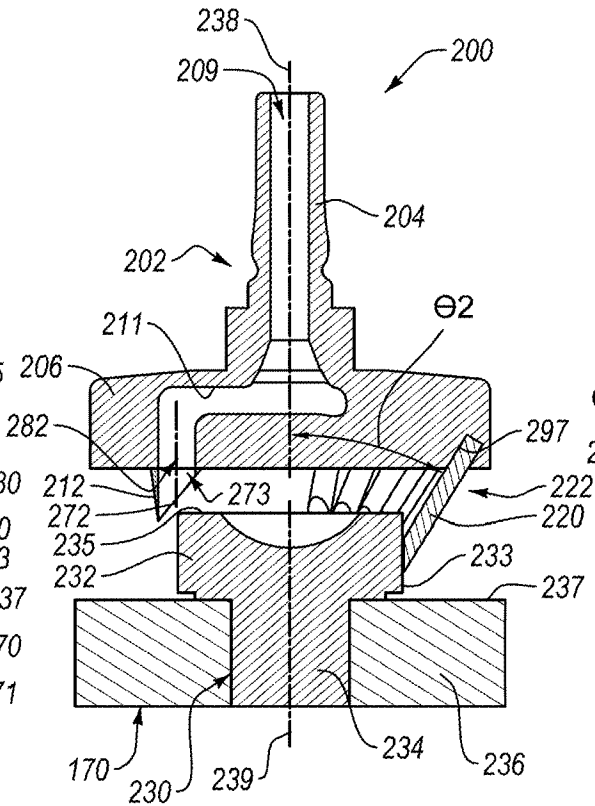
Figure 2:
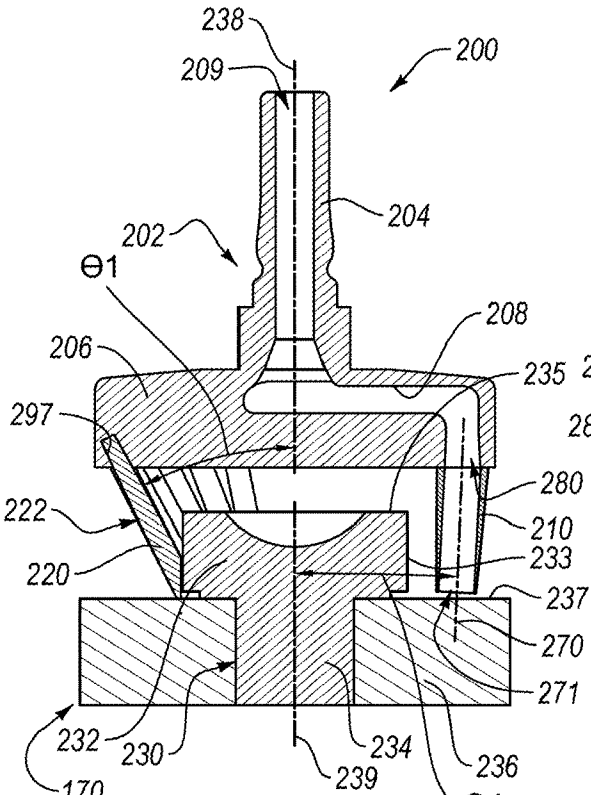
Figure 5:
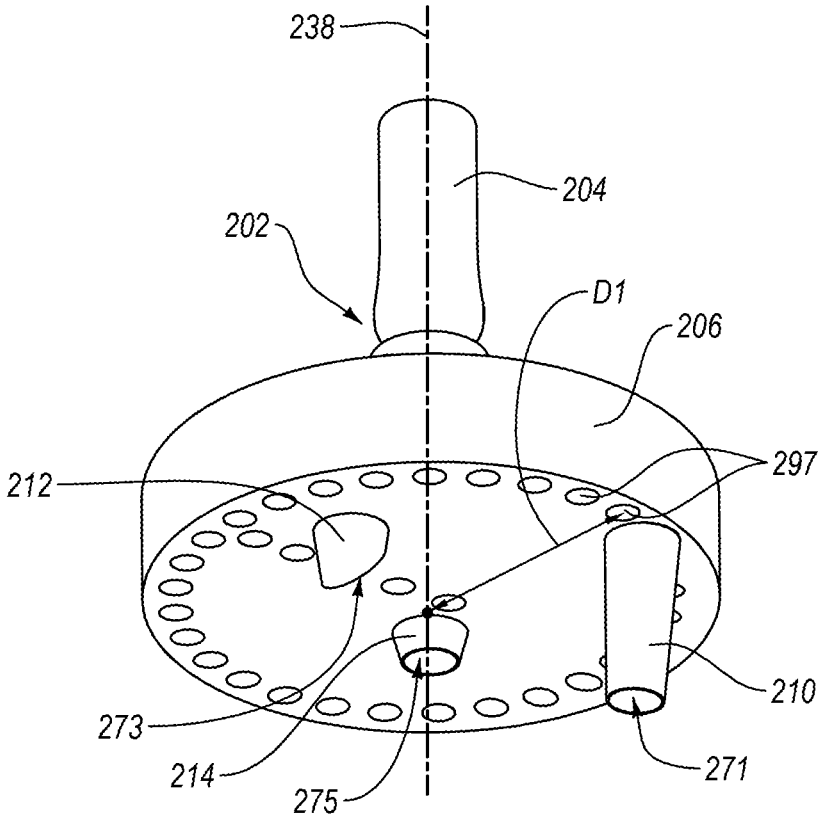
Figure 6A:
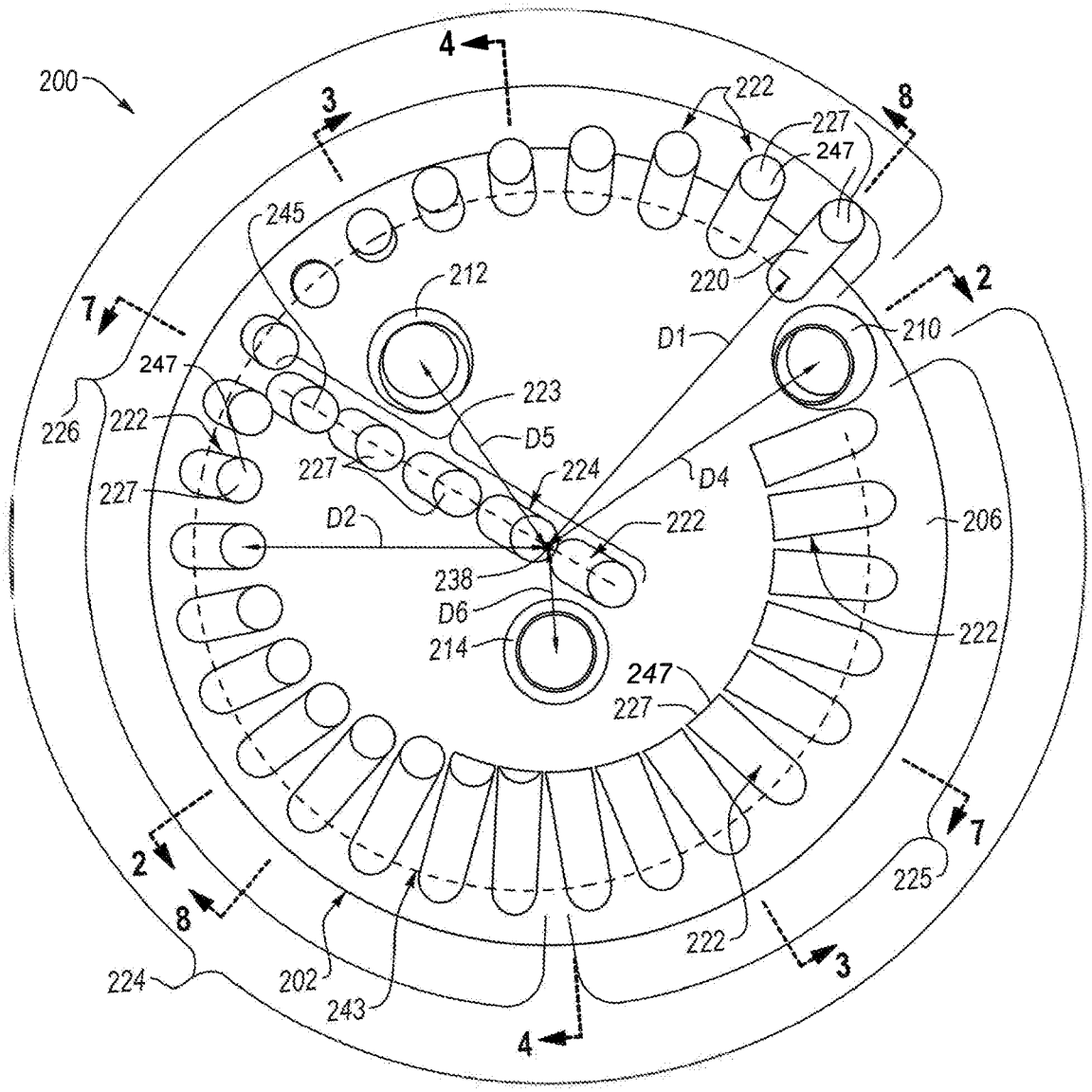
Figure 6B:
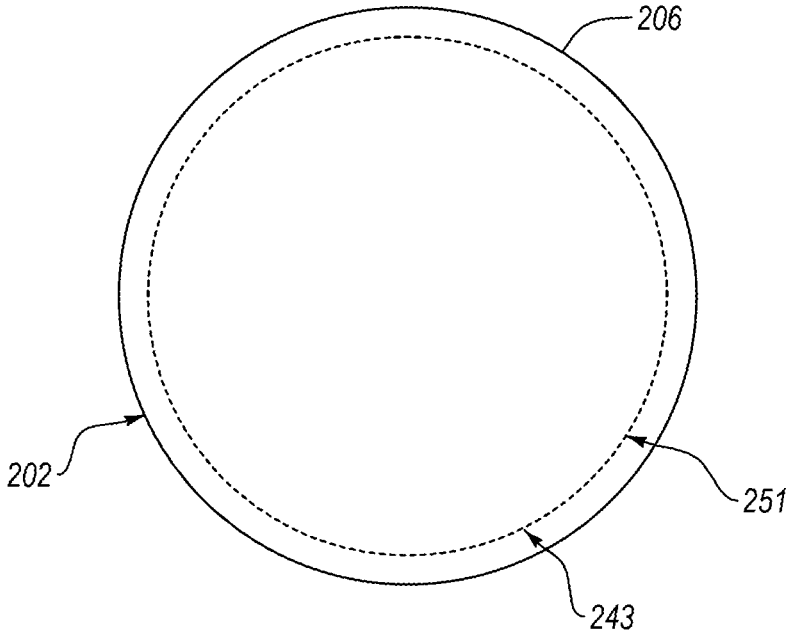
Figure 7:
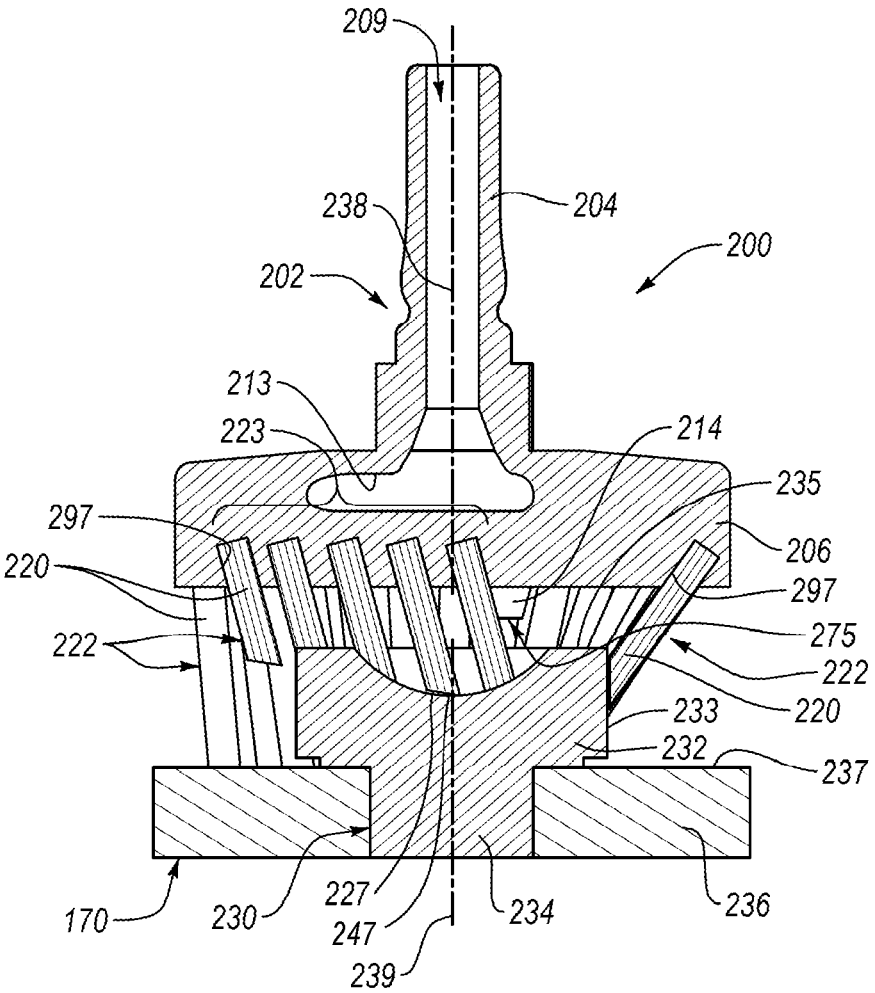
Figure 8:
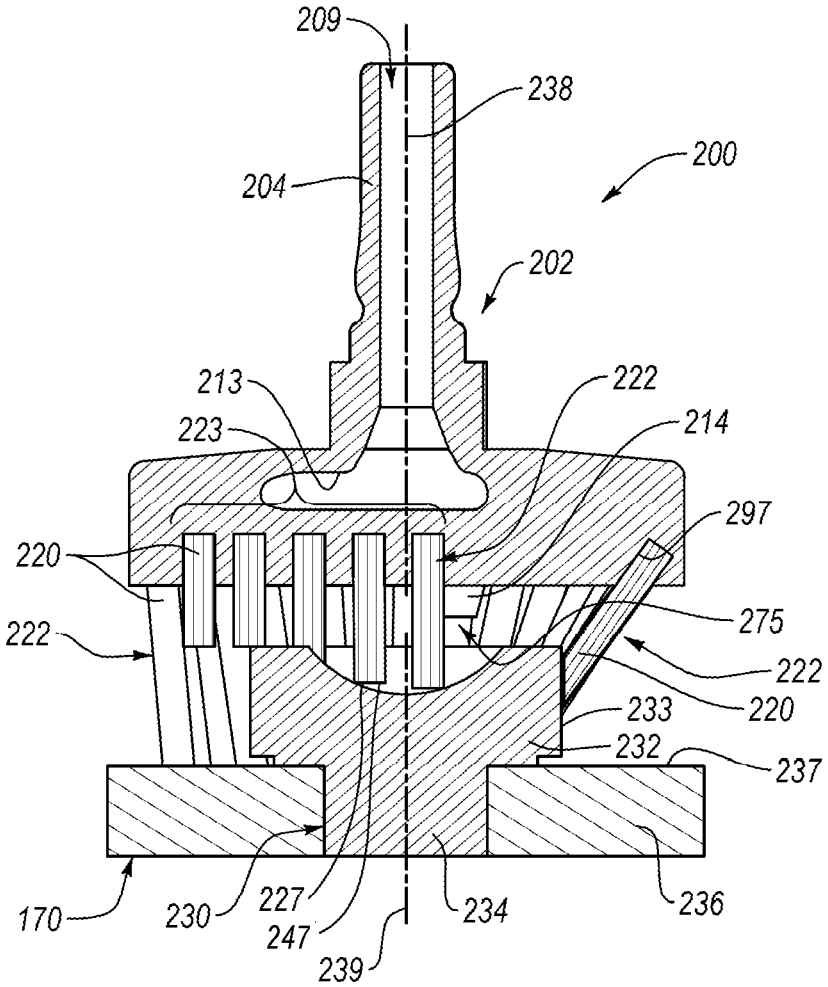
Figure 9:
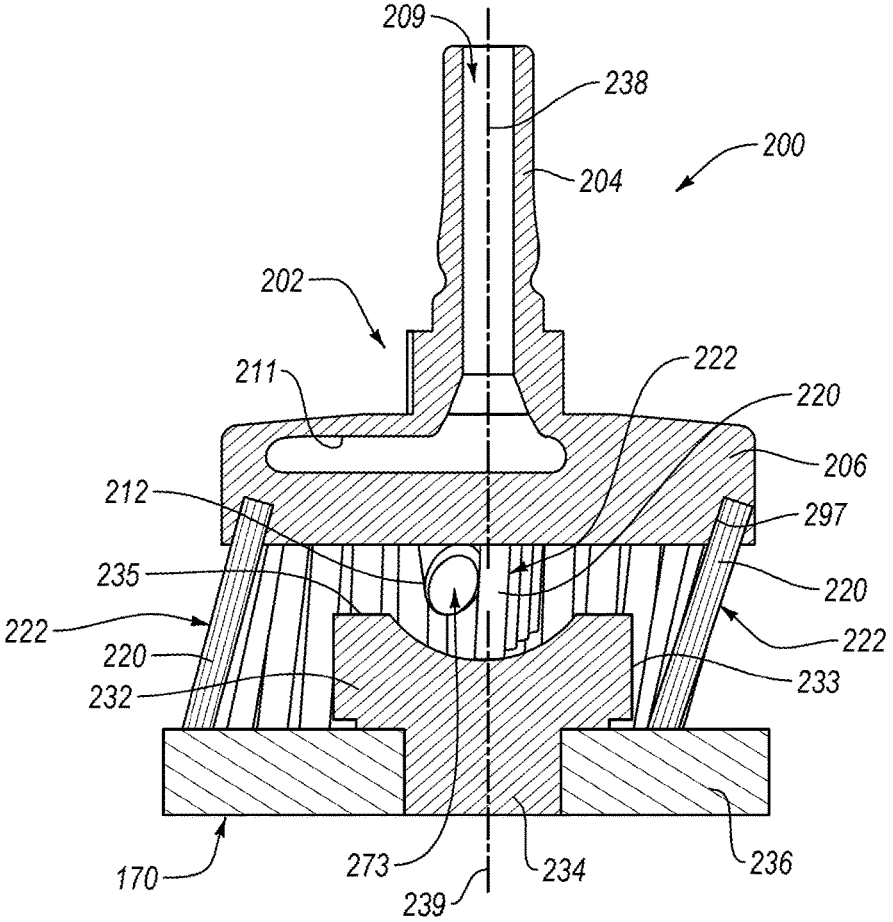
Figure 10A:
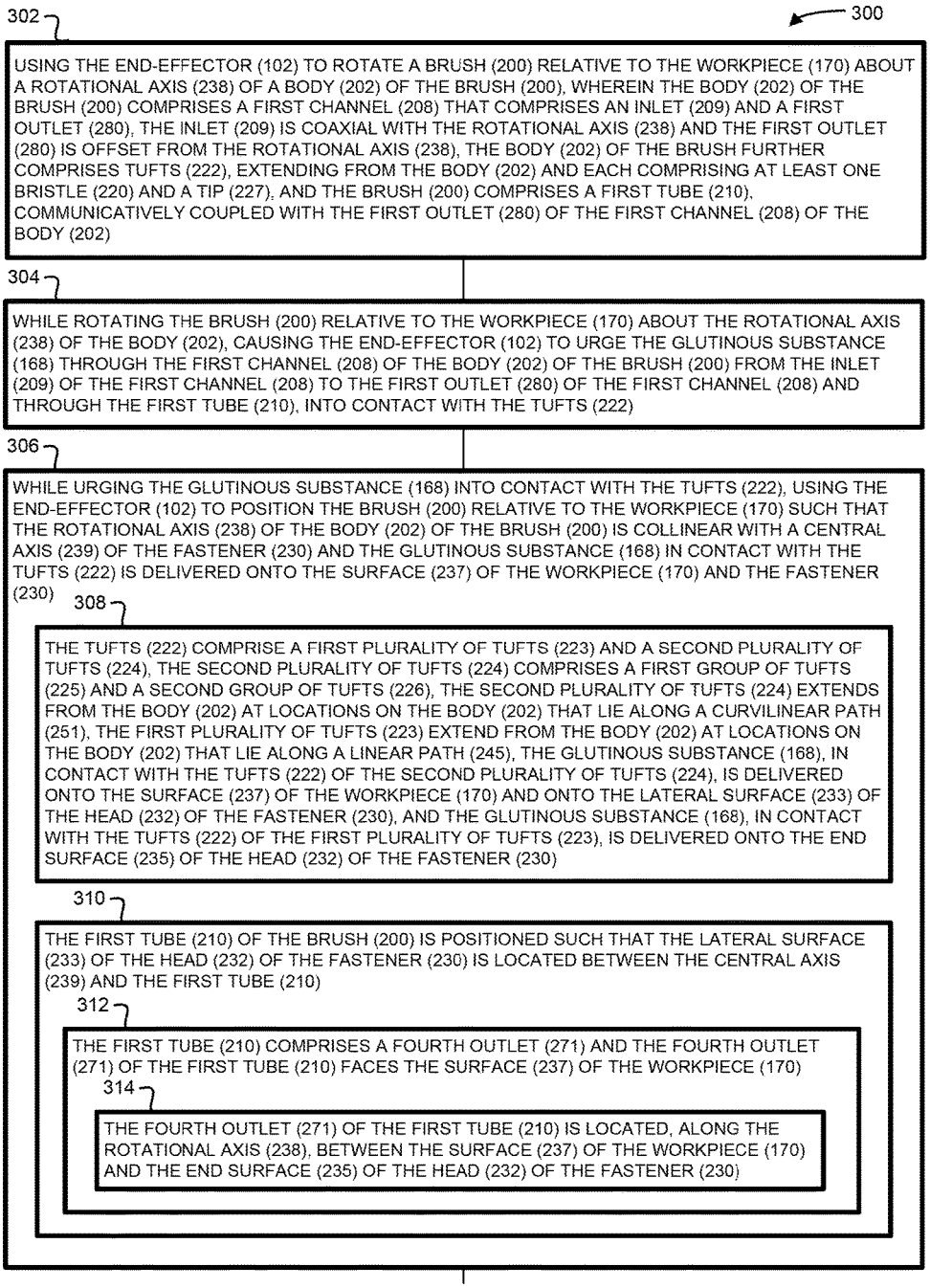
Figure 11:
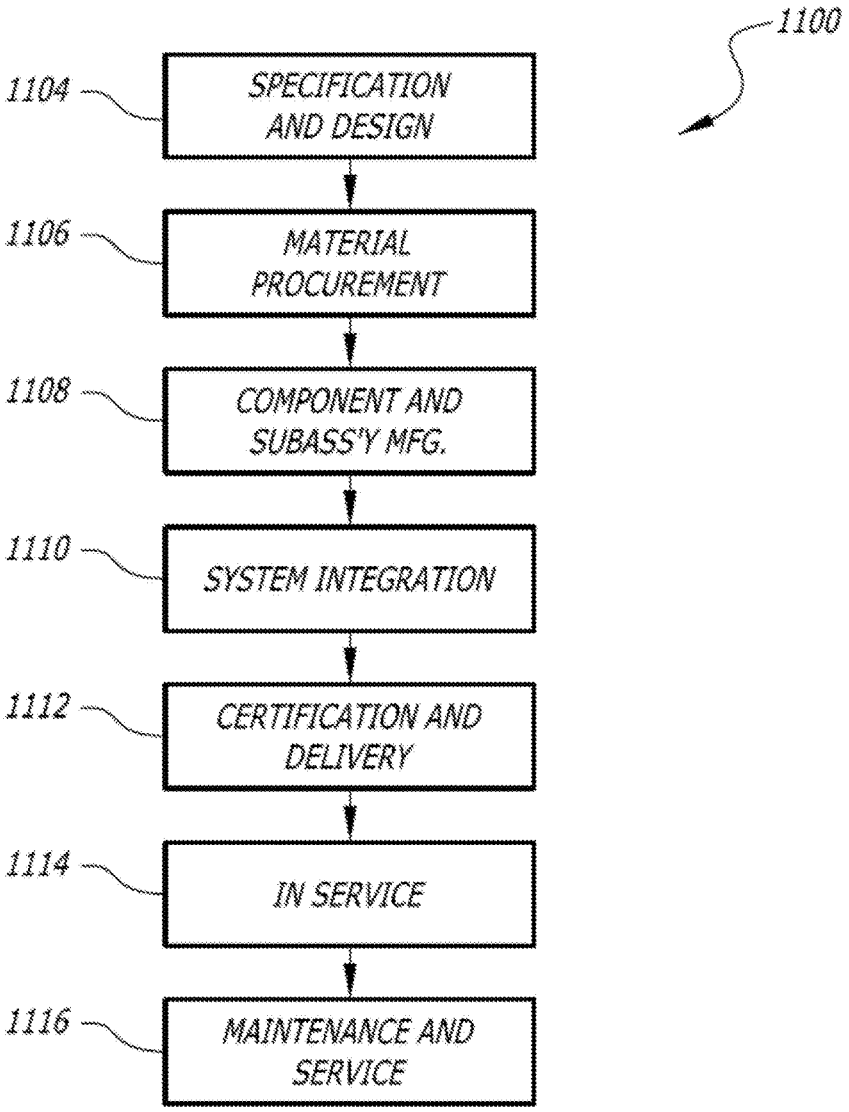
Figure 12:
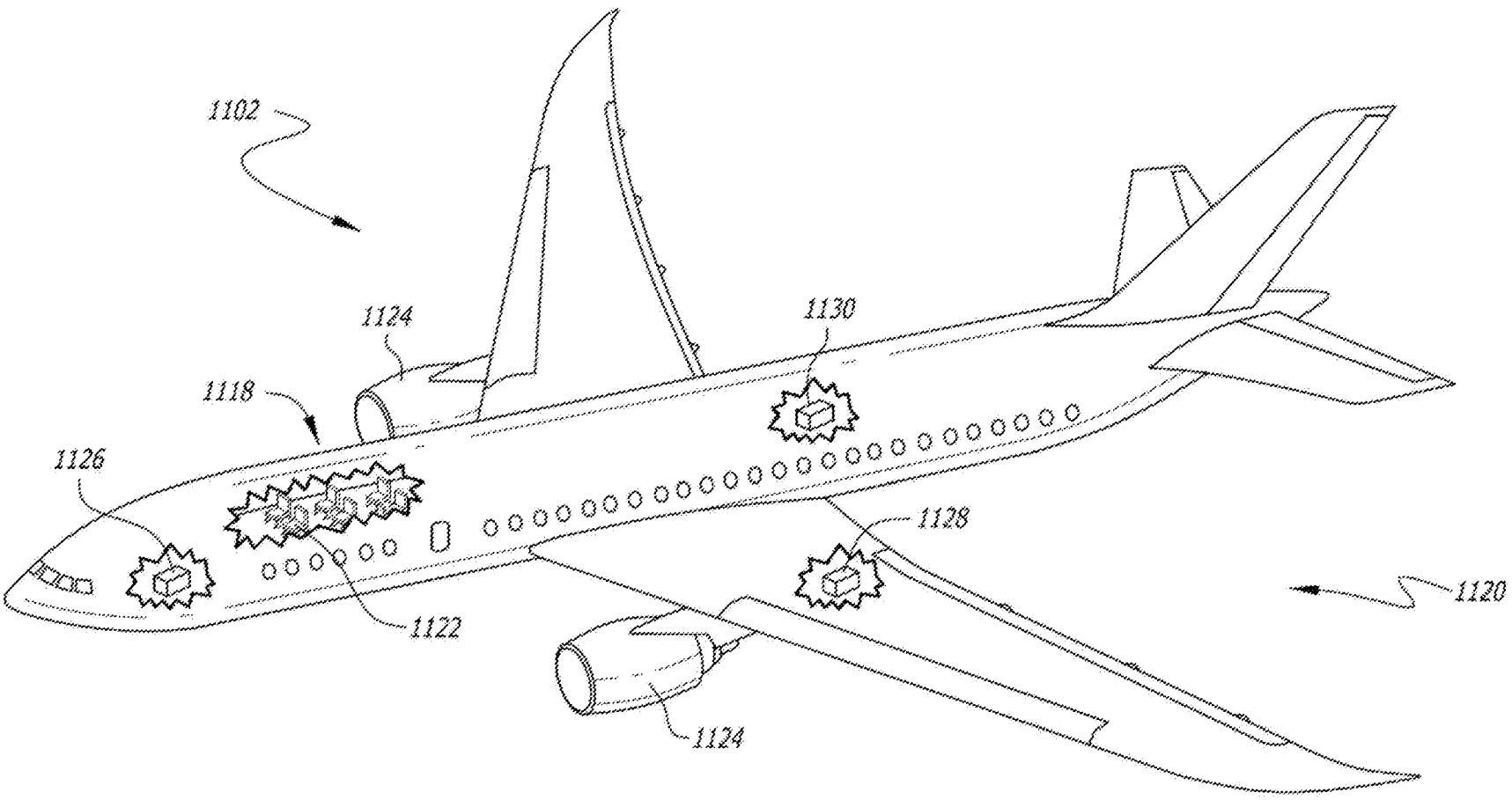

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of a brush for delivering a glutinous substance to a workpiece from an end-effector, according to one or more examples of the present disclosure;

FIG. 2 is a schematic, cross-sectional side elevation view of the brush and a workpiece of FIG. 1, according to one or more examples of the present disclosure;

FIG. 3 is a schematic, cross-sectional side elevation view of the brush and a workpiece of FIG. 1, according to one or more examples of the present disclosure;

FIG. 4 is a schematic, cross-sectional side elevation view of the brush and a workpiece of FIG. 1, according to one or more examples of the present disclosure;

FIG. 5 is a schematic, perspective view of a body and first, second, and third tubes of the brush of FIG. 1, according to one or more examples of the present disclosure;

FIG. 6A is a schematic, bottom plan view of the brush of FIG. 1, according to one or more examples of the present disclosure;

FIG. 6B is a schematic, bottom plan view of a body of the brush of FIG. 1, according to one or more examples of the present disclosure;

FIG. 7 is a schematic, cross-sectional side elevation view of the brush and a workpiece of FIG. 1, according to one or more examples of the present disclosure;

FIG. 8 is a schematic, cross-sectional side elevation view of the brush and a workpiece of FIG. 1, according to one or more examples of the present disclosure;

FIG. 9 is a schematic, cross-sectional side elevation view of the brush and a workpiece of FIG. 1, according to one or more examples of the present disclosure;

FIGS. 10A-10C collectively are a block diagram of a method of delivering a glutinous substance to a workpiece from an end-effector, according to one or more examples of the present disclosure;

FIG. 11 is a block diagram of aircraft production and service methodology; and FIG. 12 is a schematic illustration of an aircraft.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIGS. 10A-11, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 10A-11 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIG. 1 and particularly to, e.g., FIGS. 2 and 6A, brush 200 for delivering glutinous substance 168 to workpiece 170 from end-effector 102 is disclosed. Brush 200 comprises body 202, having rotational axis 238 and comprising first channel 208 that comprises inlet 209 and first outlet 280. Inlet 209 is coaxial with rotational axis 238 and first outlet 280 is offset from rotational axis 238. Additionally, brush 200 comprises tufts 222, extending from body 202 and each comprising tip 227 and at least one bristle 220. Brush 200 further comprises first tube 210, communicatively coupled with first outlet 280 of first channel 208 of body 202. The preceding subject matter of this paragraph characterizes example 1 of the present disclosure.

Brush 200 is configured to facilitate ease and efficiency associated with the application of glutinous substances onto surfaces of workpieces. Inlet 209, being coaxial with rotational axis 238 of body 202, allows flow of glutinous substance 168 through first channel 208 as brush 200 rotates about rotational axis 238. First outlet 280 of first channel 208 of body 202, being offset from rotational axis 238, helps distribute glutinous substance 168 to locations offset from rotational axis 238. First tube 210 facilitates flow of glutinous substance 168 from first outlet 280 of first channel 208 of body 202 to workpiece 170. Tufts 222 promote the spreading and uniform distribution of glutinous substance 168 on workpiece 170.

In some examples, body 202 of brush 200 includes shaft 204 and head 206. Shaft 204 may be configured to be coupled to end-effector 102 in co-rotatable engagement with end-effector 102. Head 206 has a larger cross-sectional area, in a plane perpendicular to rotational axis 238, than shaft 204. Inlet 209 can be defined by shaft 204 and first outlet 280 can be defined by head 206. In one example, body 202 of brush 200 has a one-piece monolithic construction. In such an example, body 202 can be made of metal. In yet some examples, body 202 can have a multi-piece construction. According to certain examples, shaft 204 is made of metal. According to some examples, tufts 222 are spaced-apart from each other.

Referring generally to FIG. 1 and particularly to, e.g., FIGS. 2 and 6A, first tube 210 is more flexible than body 202 of brush 200. The preceding subject matter of this paragraph characterizes example 2 of the present disclosure, wherein example 2 also includes the subject matter according to example 1, above.

First tube 210, being more flexible than body 202, absorbs potential impacts with workpiece 170, while brush 200 delivers glutinous substance 168 to workpiece 170, more effectively than body 202. For example, first tube 210 can be configured to flex upon an impact with workpiece 170 while brush 200 delivers glutinous substance 168 to workpiece 170.

Referring generally to FIG. 1 and particularly to, e.g., FIG. 2, first channel 208 is cross-sectionally circumferentially closed. The preceding subject matter of this paragraph characterizes example 3 of the present disclosure, wherein example 3 also includes the subject matter according to any one of examples 1 or 2, above.

First channel 208, being cross-sectionally circumferentially closed, facilitates discrete containment of the flow of glutinous substance 168 through body 202.

Referring generally to FIG. 1 and particularly to, e.g., FIG. 2, first tube 210 extends from body 202 a shorter distance than at least one of tufts 222 along rotational axis 238 of body 202. The preceding subject matter of this paragraph characterizes example 4 of the present disclosure, wherein example 4 also includes the subject matter according to any one of examples 1 to 3, above.

First tube 210, extending from body 202 a shorter distance than at least one of tufts 222 along rotational axis 238 of body 202, helps to promote spreading and uniform distribution of glutinous substance 168 delivered from first tube 210 to workpiece 170 by at least one of tufts 222.

Referring generally to FIG. 1 and particularly to, e.g., FIG. 2, first tube 210 is parallel to rotational axis 238 of body 202. The preceding subject matter of this paragraph characterizes example 5 of the present disclosure, wherein example 5 also includes the subject matter according to any one of examples 1 to 4, above.

First tube 210, being parallel to rotational axis 238 of body 202, facilitates flow of glutinous substance 168 onto workpiece 170 in a direction parallel to rotational axis 238 of body 202.

Referring generally to FIG. 1 and particularly to, e.g., FIG. 2, first tube 210 is oblique to rotational axis 238 of body 202. The preceding subject matter of this paragraph characterizes example 6 of the present disclosure, wherein example 6 also includes the subject matter according to any one of examples 1 to 4, above.

First tube 210, being oblique to rotational axis 238 of body 202, enables first tube 210 to flex into an orientation parallel to rotational axis 238 of body 202 when brush 200 is being rotated. For example, while brush 200 is being rotated, contact with workpiece 107 by first tube 210 may cause first tube 210 to flex from being oblique to rotational axis 238 of body 202 to being parallel to rotational axis 238 of body 202. When first tube 210 is in an unflexed state, first central axis 270 of first tube 210 can form angle θ4 with rotational axis 238.

Referring generally to FIG. 1 and particularly to, e.g., FIGS. 2, 3, 6A, and 7-9, at least two of tufts 222 are oblique to each other. The preceding subject matter of this paragraph characterizes example 7 of the present disclosure, wherein example 7 also includes the subject matter according to any one of examples 1 to 6, above.

At least two of tufts 222, being oblique to each other, promotes broader coverage of glutinous substance 168 on workpiece 170. For example, one tuft 222 can form angle θ1 with rotational axis 238, another tuft 222 can form angle θ2 with rotational axis 238, and yet another tuft 222 can form angle θ3, where at least two of angle θ1, angle θ2, and angle θ3 are different from each other.

Referring generally to FIG. 1 and particularly to, e.g., FIGS. 6A, 8, and 9, at least one of tufts 222 is parallel to rotational axis 238 of body 202 and at least another one of tufts 222 is oblique to rotational axis 238 of body 202. The preceding subject matter of this paragraph characterizes example 8 of the present disclosure, wherein example 8 also includes the subject matter according to any one of examples 1 to 7, above.

At least one of tufts 222, being parallel to rotational axis 238 of body 202, and at least another one of tufts 222, being oblique to rotational axis 238 of body 202, promote broader coverage of glutinous substance 168 on workpiece 170.

Referring generally to FIG. 1 and particularly to, e.g., FIGS. 6A and 9, at least a first one of tufts 222 is oblique to rotational axis 238 of body 202. Tip 227 of at least the first one of tufts 222 is farther away from rotational axis 238 of body 202 than any other portion of at least the first one of tufts 222. The preceding subject matter of this paragraph characterizes example 9 of the present disclosure, wherein example 9 also includes the subject matter according to any one of examples 1 to 8, above.

Tip 227 of at least the first one of tufts 222, being farther away from rotational axis 238 of body 202 than any other portion of at least the first one of tufts 222, facilitates coverage of glutinous substance 168 on workpiece 170 at locations on workpiece 170 farther away from rotational axis 238 than where at least the first one of tufts 222 extends from body 202. Tips 227 of tufts 222 are positioned second distance D2 away from rotational axis 238.

Referring generally to FIG. 1 and particularly to, e.g., FIGS. 2-4, 6A, and 7-9, at least a second one of tufts 222 is oblique to rotational axis 238 of body 202. Tip 227 of at least the second one of tufts 222 is closer to rotational axis 238 of body 202 than any other portion of at least the second one of tufts 222. The preceding subject matter of this paragraph characterizes example 10 of the present disclosure, wherein example 10 also includes the subject matter according to example 9, above.

Tip 227 of at least the second one of tufts 222, being closer to rotational axis 238 of body 202 than any other portion of at least the second one of tufts 222, facilitates coverage of glutinous substance 168 on workpiece 170 at locations on workpiece 170 closer to rotational axis 238 than where at least the second one of tufts 222 extends from body 202.

Referring generally to FIG. 1 and particularly to, e.g., FIGS. 6A and 6B, tufts 222 comprise first plurality of tufts 223 and second plurality of tufts 224. Second plurality of tufts 224 comprises first group of tufts 225 and second group of tufts 226. Second plurality of tufts 224 extends from body 202 at locations on body 202 that lie along curvilinear path 251. The preceding subject matter of this paragraph characterizes example 11 of the present disclosure, wherein example 11 also includes the subject matter according to any one of examples 1 to 10, above.

Second plurality of tufts 224, extending from body 202 at locations on body 202 that lie along curvilinear path 251, promote application of glutinous substance 168 onto surface 237 of workpiece 170 around head 232 of fastener 230 and onto at least lateral surface 233 of head 232 of fastener 230. Tufts 222 extend from body 202 at locations first distance D1 away from rotational axis 238.

In some examples, fastener 230 has central axis 239 and comprises shank 234, extending at least partially through workpiece 170, and head 232, extending from workpiece 170. Head 232 comprises end surface 235 that may comprise a recess or depression. According to certain examples, lateral surface 233 of head 232 of fastener 230 is parallel to central axis 239 of fastener 230 and end surface 235 of head 232 of fastener 230 is perpendicular to central axis 239 of fastener 230.

Referring generally to FIG. 1 and particularly to, e.g., FIG. 6A, tips 227 of first group of tufts 225 are equidistant from rotational axis 238 of body 202. The preceding subject matter of this paragraph characterizes example 12 of the present disclosure, wherein example 12 also includes the subject matter according to example 11, above.

Tips 227 of first group of tufts 225 of second plurality of tufts 224, being equidistant from rotational axis 238 of body 202, promote uniform coverage of glutinous substance 168 onto lateral surface 233 of head 232 of fastener 230.

Referring generally to FIG. 1 and particularly to, e.g., FIG. 6A, tips 227 of first group of tufts 225 are each differently spaced from a virtual plane, perpendicular to rotational axis 238 of body 202. The preceding subject matter of this paragraph characterizes example 13 of the present disclosure, wherein example 13 also includes the subject matter according to any one of examples 11 or 12, above.

Tips 227 of first group of tufts 225, each being differently spaced from a virtual plane perpendicular to rotational axis 238 of body 202, provides for broader or complete coverage of lateral surface 233 of head 232 of fastener 230 along central axis 239 of fastener 230.

As used herein, "virtual" means having attributes of an entity without possessing its physical form. For example, a virtual reference plane is an intangible or imaginary plane, rather than a physical one, with respect to which, e.g., location and/or orientation of other physical and/or intangible entities may be defined.

Referring generally to FIG. 1 and particularly to, e.g., FIG. 6A, tips 227 of second group of tufts 226 are equidistant from a virtual plane, perpendicular to rotational axis 238 of body 202. The preceding subject matter of this paragraph characterizes example 14 of the present disclosure, wherein example 14 also includes the subject matter according to any one of examples 11 to 13, above.

Tips 227 of second group of tufts 226, being equidistant from a virtual plane perpendicular to rotational axis 238 of body 202, promotes uniform coverage of glutinous substance 168 on surface 237 of workpiece 170 around head 232 of fastener 230.

Referring generally to FIG. 1 and particularly to, e.g., FIG. 6A, tips 227 of second group of tufts 226 are each differently spaced from rotational axis 238 of body 202. The preceding subject matter of this paragraph characterizes example 15 of the present disclosure, wherein example 15 also includes the subject matter according to any one of examples 11 to 14, above.

Tips 227 of second group of tufts 226, each being differently spaced from rotational axis 238 of body 202, promotes broader coverage of surface 237 of workpiece 170 away from rotational axis 238 of body 202 in directions perpendicular to rotational axis 238.

Referring generally to FIG. 1 and particularly to, e.g., FIG. 6A, each of tips 227 of each of tufts 222 comprises end face 247. End faces 247 of first group of tufts 225 are parallel to rotational axis 238 of body 202. End faces 247 of second group of tufts 226 are perpendicular to rotational axis 238 of body 202. The preceding subject matter of this paragraph characterizes example 16 of the present disclosure, wherein example 16 also includes the subject matter according to any one of examples 11 to 15, above.

End faces 247 of first group of tufts 225, being parallel to rotational axis 238 of body 202, promote uniform coverage of glutinous substance 168 onto lateral surface 233 of head 232 of fastener 230. End faces 247 of second group of tufts 226, being perpendicular to rotational axis 238 of body 202, promote uniform coverage of glutinous substance 168 on surface 237 of workpiece 170 around head 232 of fastener 230.

Referring generally to FIG. 1 and particularly to, e.g., FIG. 6A, curvilinear path 251, along which second plurality of tufts 224 extends from body 202, is spiral path 241. The preceding subject matter of this paragraph characterizes example 17 of the present disclosure, wherein example 17 also includes the subject matter according to any one of examples 11-16, above.

Spiral path 241 promotes positioning of second plurality of tufts 224 around fastener 230 and accommodates coupling of second plurality of tufts 224 to body 202. For example, curvilinear path 251, being spiral path 241, provides body 202 with enough material to accommodate the formation of receptacles 297 in body 202, which receive and retain respective ones of plurality of tufts 224.

Referring generally to FIG. 1 and particularly to, e.g., FIG. 6B, curvilinear path 251, along which second plurality of tufts 224 extends from body 202, is circular path 243. The preceding subject matter of this paragraph characterizes example 18 of the present disclosure, wherein example 18 also includes the subject matter according to any one of examples 11 to 16, above.

Circular path 243 promotes positioning of second plurality of tufts 224 around fastener 230.

Referring generally to FIG. 1 and particularly to, e.g., FIG. 6B, the locations on body 202 that lie along circular path 243 are equidistant from rotational axis 238 of body 202. The preceding subject matter of this paragraph characterizes example 19 of the present disclosure, wherein example 19 also includes the subject matter according to example 18, above.

Locations on body 202 that lie along circular path 243, being equidistant from rotational axis 238 of body 202, facilitate positioning of second plurality of tufts 224 around fastener 230.

Referring generally to FIG. 1 and particularly to, e.g., FIG. 6A, tufts (222) of first plurality of tufts 223 extend from body 202 at locations on body 202 that lie along linear path 245. The preceding subject matter of this paragraph characterizes example 20 of the present disclosure, wherein example 20 also includes the subject matter according to any one of examples 11 to 19, above.

Laying first plurality of tufts 223 at locations on body 202 along linear path 245 facilitates application of glutinous substance 168 onto end surface 235 of fastener 230.

Referring generally to FIG. 1 and particularly to, e.g., FIG. 6A, linear path 245 does not intersect rotational axis 238 of body 202. The preceding subject matter of this paragraph characterizes example 21 of the present disclosure, wherein example 21 also includes the subject matter according to example 20, above.

Linear path 245 not intersecting rotational axis 238 of body 202 provides ability to apply glutinous substance 168 to less than all portions of end surface 235 of head 232 of fastener 230. For example, it may be desirable to not apply glutinous substance 168 to a tool engagement recess in end surface 235 of head 232 of fastener 230.

Referring generally to, e.g., FIG. 1 and particularly to FIGS. 6A and 7, linear path 245 intersects rotational axis 238 of body 202. The preceding subject matter of this paragraph characterizes example 22 of the present disclosure, wherein example 22 also includes the subject matter according to example 20, above.

Linear path 245 intersecting rotational axis 238 of body 202 facilitates application of glutinous substance 168 to all portions of end surface 235 of head 232 of fastener 230, including a portion of end surface 234 proximate central axis 239 of fastener 230.

Referring generally to, e.g., FIG. 1 and particularly to FIGS. 4, 6A, and 7 each of first plurality of tufts 223 is oblique to rotational axis 238 of body 202. The preceding subject matter of this paragraph characterizes example 23 of the present disclosure, wherein example 23 also includes the subject matter according to any one of examples 20 to 22, above.

Each of first plurality of tufts 223, being oblique to rotational axis 238 of body 202, promotes coverage of glutinous substance 168 on end surface 235 of head 232 of fastener 230. For example, each of first plurality of tufts 223, being oblique to rotational axis 238 of body 202, may facilitate application of glutinous substance 168 on unique or hard-to-reach features on end surface 235 of head 232 of fastener 230.

Referring generally to, e.g., FIG. 1 and particularly to FIG. 8, each of first plurality of tufts 223 is parallel to rotational axis 238 of body 202. The preceding subject matter of this paragraph characterizes example 24 of the present disclosure, wherein example 24 also includes the subject matter according to any one of examples 20 to 22, above.

Each of first plurality of tufts 223, being parallel to rotational axis 238 of body 202, promotes coverage of glutinous substance 168 on end surface 235 of head 232 of fastener 230.

Referring generally to, e.g., FIG. 1 and particularly to FIGS. 4 and 7, each of tips 227 of first plurality of tufts 223 comprises end face 247. End face 247 of at least one of tips 227 of first plurality of tufts 223 is oblique to rotational axis 238 of body 202. The preceding subject matter of this paragraph characterizes example 25 of the present disclosure, wherein example 25 also includes the subject matter according to any one of examples 20 to 24, above.

End face 247 of at least one of tips 227 of first plurality of tufts 223, being oblique to rotational axis 238 of body 202, promotes application of glutinous substance 168 to portions of end surface 235 of head 232 of fastener 230 that are oblique to rotational axis 238.

Referring generally to, e.g., FIG. 1 and particularly to FIG. 7, end faces 247 of at least two of tips 227 of first plurality of tufts 223 are oblique to each other. The preceding subject matter of this paragraph characterizes example 26 of the present disclosure, wherein example 26 also includes the subject matter according to example 25, above.

End faces 247 of at least two of tips 227 of first plurality of tufts 223, being oblique to each other, promote application of glutinous substance 168 to portions of end surface 235 of head 232 of fastener 230 that are oblique to each other. For example, one of end faces 247 of at least two of tips 227 of first plurality of tufts 223 that are oblique to each other may apply glutinous substance 168 to a first side of a recess formed in end surface 235 and another of at least two of tips 227 of first plurality of tufts 223 that are oblique to each other may apply glutinous substance 168 to a second side of the recess, opposite the first side.

Referring generally to, e.g., FIG. 1 and particularly to FIGS. 4, 7, 8, at least two of first plurality of tufts 223 have different lengths. The preceding subject matter of this paragraph characterizes example 27 of the present disclosure, wherein example 27 also includes the subject matter according to any one of examples 20 to 26, above.

At least two of first plurality of tufts 223 having different lengths promotes application of glutinous substance 168 to portions of end surface 235 of head 232 of fastener 230 at different elevations relative to each other. For example, at least two of first plurality of tufts 223 having different lengths promotes application of glutinous substance 168 to a recess formed in end surface 235 of head 232 of fastener 230.

Referring generally to, e.g., FIG. 1 and particularly to FIGS. 6A and 7-9, angular orientations of at least some of tufts 222 relative to a virtual plane perpendicular to rotational axis 238 of body 202 are different. The preceding subject matter of this paragraph characterizes example 28 of the present disclosure, wherein example 28 also includes the subject matter according to any one of examples 1 to 27, above.

Angular orientations of at least some of tufts 222 relative to a virtual plane perpendicular to rotational axis 238 of body 202, being different, promotes application of glutinous substance 168 to different portions of surface 237 of workpiece 170 and/or lateral surface 233 of head 232 of fastener 230. Application of glutinous substance 168 to different portions of surface 237 of workpiece 170 and/or lateral surface 233 of head 232 of fastener 230 facilitates broader coverage of glutinous substance 168 on workpiece 170.

Referring generally to, e.g., FIG. 1 and particularly to FIGS. 4, 6A, 7, and 8, angular orientations of at least some of tufts 222 relative to a virtual plane perpendicular to rotational axis 238 of body 202 are identical. The preceding subject matter of this paragraph characterizes example 29 of the present disclosure, wherein example 29 also includes the subject matter according to any one of examples 1 to 28, above.

Angular orientations of at least some of tufts 222 relative to a virtual plane perpendicular to rotational axis 238 of body 202, being identical, promotes uniform application of glutinous substance 168 to workpiece 170.

Referring generally to, e.g., FIG. 1 and particularly to FIGS. 3, 4, 7, and 8, lengths of at least some of tufts 222, extending from body 202, are different. The preceding subject matter of this paragraph characterizes example 30 of the present disclosure, wherein example 30 also includes the subject matter according to any one of examples 1 to 29, above.

At least some of tufts 223 having different lengths promotes application of glutinous substance 168 to portions of workpiece 170 at different elevations relative to each other. Additionally, at least some of tufts 223 having different lengths allows tufts 223 to be oblique relative to each other, but still uniformly apply glutinous substance 168 co-planar portions of workpiece 170.

Referring generally to, e.g., FIG. 1 and particularly to FIGS. 3, 5, 6A, and 9, body 202 further comprises second channel 211, comprising inlet 209 and second outlet 282. Second outlet 282 is offset from rotational axis 238. Brush 200 further comprises second tube 212, communicatively coupled with second outlet 282 of second channel 211 of body 202. The preceding subject matter of this paragraph characterizes example 31 of the present disclosure, wherein example 31 also includes the subject matter according to any one of examples 1 to 30, above.

Second outlet 282 of second channel 211 of body 202, being offset from rotational axis 238, helps distribute glutinous substance 168 to locations offset from rotational axis 238. Second tube 212 facilitates flow of glutinous substance 168 from second outlet 282 of second channel 211 of body 202 to workpiece 170. Inlet 209 forming part of both first channel 208 and second channel 211 simplifies distribution of glutinous substance 168 from end-effector 102 to multiple outlets of body 202 offset from rotational axis 238 of body 202, and further facilitates flow of glutinous substance 168 through first channel 208 and second channel 211 as brush 200 rotates about rotational axis 238.

Referring generally to, e.g., FIG. 1 and particularly to FIGS. 3, 5, 6A, and 9, second tube 212 is more flexible than body 202 of brush 200. The preceding subject matter of this paragraph characterizes example 32 of the present disclosure, wherein example 32 also includes the subject matter according to example 31, above.

Second tube 212, being more flexible than body 202, absorbs potential impacts with workpiece 170, while brush 200 delivers glutinous substance 168 to workpiece 170, more effectively than body 202. For example, second tube 212 can be configured to flex upon an impact with workpiece 170 while brush 200 delivers glutinous substance 168 to workpiece 170.

Referring generally to, e.g., FIG. 1 and particularly to FIG. 3, second channel 211 is cross-sectionally circumferentially closed. The preceding subject matter of this paragraph characterizes example 33 of the present disclosure, wherein example 33 also includes the subject matter according to any one of examples 31 or 32, above.

Second channel 211, being cross-sectionally circumferentially closed, facilitates discrete containment of the flow of glutinous substance 168 through body 202.

Referring generally to FIG. 1 and particularly to, e.g., FIGS. 3 and 9, second tube 212 extends from body 202 a shorter distance than at least one of tufts 222 along rotational axis 238 of body 202. The preceding subject matter of this paragraph characterizes example 34 of the present disclosure, wherein example 34 also includes the subject matter according to any one of examples 31 to 33, above.

Second tube 212, extending from body 202 a shorter distance than at least one of tufts 222 along rotational axis 238 of body 202, helps to promote spreading and uniform distribution of glutinous substance 168 delivered from second tube 212 to workpiece 170 by at least one of tufts 222.

Referring generally to FIG. 1 and particularly to, e.g., FIGS. 3 and 9, second tube 212 is parallel to rotational axis 238 of body 202. The preceding subject matter of this paragraph characterizes example 35 of the present disclosure, wherein example 35 also includes the subject matter according to any one of examples 31 to 34, above.

Second tube 212, being parallel to rotational axis 238 of body 202, facilitates flow of glutinous substance 168 onto workpiece 170 in a direction parallel to rotational axis 238 of body 202.

Referring generally to FIG. 1 and particularly to, e.g., FIGS. 4-6A, 7, and 8, body 202 further comprises third channel 213, comprising inlet 209 and third outlet 284. Third outlet 284 is offset from rotational axis 238. Brush 200 further comprises third tube 214, communicatively coupled with third outlet 284 of third channel 213 of body 202. The preceding subject matter of this paragraph characterizes example 36 of the present disclosure, wherein example 36 also includes the subject matter according to any one of examples 31 to 35, above.

Third outlet 284 of third channel 213 of body 202, being offset from rotational axis 238, helps distribute glutinous substance 168 to locations offset from rotational axis 238. Third tube 214 facilitates flow of glutinous substance 168 from third outlet 284 of third channel 213 of body 202 to workpiece 170. Inlet 209 forming part of first channel 208, second channel 211, and third channel 213 simplifies distribution of glutinous substance 168 from end-effector 102 to multiple outlets of body 202 offset from rotational axis 238 of body 202, and further facilitates flow of glutinous substance 168 through first channel 208, second channel 211, and third channel 213 as brush 200 rotates about rotational axis 238.

Referring generally to FIG. 1 and particularly to, e.g., FIGS. 4-6A, 7, and 8, third tube 214 is more flexible than body 202 of brush 200. The preceding subject matter of this paragraph characterizes example 37 of the present disclosure, wherein example 37 also includes the subject matter according to example 36, above.

Third tube 214, being more flexible than body 202, absorbs potential impacts with workpiece 170, while brush 200 delivers glutinous substance 168 to workpiece 170, more effectively than body 202. For example, third tube 214 can be configured to flex upon an impact with workpiece 170 while brush 200 delivers glutinous substance 168 to workpiece 170.

Referring generally to FIG. 1 and particularly to, e.g., FIGS. 4, 7, and 8, third channel 213 is cross-sectionally circumferentially closed. The preceding subject matter of this paragraph characterizes example 38 of the present disclosure, wherein example 38 also includes the subject matter according to any one of examples 36 or 37, above.

Third channel 213, being cross-sectionally circumferentially closed, facilitates discrete containment of the flow of glutinous substance 168 through body 202.

Referring generally to FIG. 1 and particularly to, e.g., FIGS. 4, 7, and 8, third tube 214 extends from body 202 a shorter distance than at least one of tufts 222 along rotational axis 238 of body 202. The preceding subject matter of this paragraph characterizes example 39 of the present disclosure, wherein example 39 also includes the subject matter according to any one of examples 36 to 38, above.

Third tube 214, extending from body 202 a shorter distance than at least one of tufts 222 along rotational axis 238 of body 202, helps to promote spreading and uniform distribution of glutinous substance 168 delivered from third tube 214 to workpiece 170 by at least one of tufts 222.

Referring generally to FIG. 1 and particularly to, e.g., FIGS. 4, 7, and 8, third tube 214 is parallel to rotational axis 238 of body 202. The preceding subject matter of this paragraph characterizes example 40 of the present disclosure, wherein example 40 also includes the subject matter according to any one of examples 36 to 39, above.

Third tube 214, being parallel to rotational axis 238 of body 202, facilitates flow of glutinous substance 168 onto workpiece 170 in a direction parallel to rotational axis 238 of body 202.

Referring generally to FIG. 1 and particularly to, e.g., FIGS. 2-5, first tube 210 extends from body 202 a longer distance than second tube 212 along rotational axis 238 of body 202. Second tube 212 extends from body 202 a longer distance than third tube 214 along rotational axis 238 of body 202. The preceding subject matter of this paragraph characterizes example 41 of the present disclosure, wherein example 41 also includes the subject matter according to any one of examples 36 to 40, above.

First tube 210 extending from body 202 a longer distance than second tube 212, and second tube 212 extending from body 202 a longer distance than third tube 214, promotes the delivery of glutinous substance 168 to workpiece 170 at different elevations relative to workpiece 170. In some examples, first tube 210 extends from body 202 a longer distance than second tube 212, and second tube 212 extends from body 202 a longer distance than third tube 214, to accommodate the delivery of glutinous substance 168 to different features of workpiece 170, some at different elevations relative to each other. For example, first tube 210 may be distanced along rotational axis 238 to deliver glutinous substance 168 to surface 237 of workpiece 170, second tube 212 may be distanced along rotational axis 238 to deliver glutinous substance 168 to lateral surface 233 and a portion of end surface 235 of head 232 of fastener 230, and third tube 214 may be distanced along rotational axis 238 to deliver glutinous substance 168 to a portion of end surface 235 of head 232 of fastener 230.

Referring generally to FIG. 1 and particularly to, e.g., FIGS. 5 and 6A, first tube 210 is located on body 202 a greater distance away from rotational axis 238 than second tube 212. Second tube 212 is located on body 202 a greater distance away from rotational axis 238 than third tube 214. The preceding subject matter of this paragraph characterizes example 42 of the present disclosure, wherein example 42 also includes the subject matter according to any one of examples 36 to 41, above.

First tube 210 is located on body 202 a greater distance away from rotational axis 238 than second tube 212, and second tube 212 is located on body 202 a greater distance away from rotational axis 238 than third tube 214, facilitates the delivery of glutinous substance 168 to workpiece 170 at different locations on workpiece 170. For example, first tube 210 may be spaced fourth distance D4 away from rotational axis 238 to deliver glutinous substance 168 to surface 237 of workpiece 170, second tube 212 may be spaced fifth distance D5 away from rotational axis 238 to deliver glutinous substance 168 to lateral surface 233 and a portion of end surface 235 of head 232 of fastener 230, and third tube 214 may be spaced distance D6 away from rotational axis 238 to deliver glutinous substance 168 to a portion of end surface 235 of head 232 of fastener 230.

Referring generally to FIG. 1 and particularly to, e.g., FIGS. 2 and 5, first tube 210 comprises first central axis 270 and fourth outlet 271. Fourth outlet 271 of first tube 210 is perpendicular to first central axis 270 of first tube 210. The preceding subject matter of this paragraph characterizes example 43 of the present disclosure, wherein example 43 also includes the subject matter according to any one of examples 36 to 42, above.

Fourth outlet 271 of first tube 210, being perpendicular to first central axis 270 of first tube 210, promotes flow of glutinous substance 168 from fourth outlet 271 of first tube 210 in direction parallel to first central axis 270 of first tube 210.

Referring generally to FIG. 1 and particularly to, e.g., FIGS. 3, 5, and 9, second tube 212 comprises second central axis 272 and fifth outlet 273. Fifth outlet 273 of second tube 212 is oblique to second central axis 272 of second tube 212. The preceding subject matter of this paragraph characterizes example 44 of the present disclosure, wherein example 44 also includes the subject matter according to any one of examples 36 to 43, above.

Fifth outlet 273 of second tube 212, being oblique to second central axis 272 of second tube 212, promotes flow of glutinous substance 168 from fifth outlet 273 of second tube 212 in direction oblique to second central axis 272 of second tube 212. According to one example, fifth outlet 273 of second tube 212, being oblique to second central axis 272 of second tube 212, facilitates flow of glutinous substance 168 from fifth outlet 273 of second tube 212 towards a corner of head 232 of fastener 230 that separates lateral surface 233 from end surface 235 of head 232.

Referring generally to FIG. 1 and particularly to, e.g., FIGS. 4, 5, 7, and 8, third tube 214 comprises third central axis 274 and sixth outlet 275. Sixth outlet 275 of third tube 214 is perpendicular to third central axis 274 of third tube 214. The preceding subject matter of this paragraph characterizes example 45 of the present disclosure, wherein example 45 also includes the subject matter according to any one of examples 36 to 44, above.

Sixth outlet 275 of third tube 214, being perpendicular to third central axis 274 of third tube 214, promotes flow of glutinous substance 168 from sixth outlet 275 of third tube 214 in direction parallel to third central axis 274 of third tube 214.

Referring generally to, e.g., FIGS. 2 and 6A and particularly to FIG. 10A, method 300 of delivering glutinous substance 168 to workpiece 170 from end-effector 102 is disclosed. Workpiece 170 comprises surface 237 and fastener 230, having head 232 that extends from surface 237 of workpiece 170. Head 232 of fastener 230 comprises lateral surface 233 and end surface 235. Method 300 comprises (block 302) using end-effector 102 to rotate brush 200 relative to workpiece 170 about rotational axis 238 of body 202 of brush 200. Body 202 of brush 200 comprises first channel 208 that comprises inlet 209 and first outlet 280. Inlet 209 is coaxial with rotational axis 238 and first outlet 280 is offset from rotational axis 238. Body 202 of brush 200 further comprises tufts 222, extending from body 202 and each comprising tip 227 and at least one bristle 220. Brush 200 comprises first tube 210, communicatively coupled with first outlet 280 of first channel 208 of body 202. Additionally, method 300 comprises (block 304), while rotating brush 200 relative to workpiece 170 about rotational axis 238 of body 202, causing end-effector 102 to urge glutinous substance 168 through first channel 208 of body 202 of brush 200 from inlet 209 of first channel 208 to first outlet 280 of first channel 208 and through first tube 210, into contact with tufts 222. Method 300 further comprises (block 306), while urging glutinous substance 168 into contact with tufts 222, using end-effector 102 to position brush 200 relative to workpiece 170 such that rotational axis 238 of body 202 of brush 200 is collinear with central axis 239 of fastener 230 and glutinous substance 168, in contact with tufts 222, is delivered onto surface 237 of workpiece 170 and fastener 230. The preceding subject matter of this paragraph characterizes example 46 of the present disclosure.

Method 300 facilitates delivery of glutinous substance 168 to workpiece 170 from end-effector 102 using brush 200 that is configured to facilitate ease and efficiency of the delivery of glutinous substance 168 onto surfaces of workpieces. Inlet 209, being coaxial with rotational axis 238 of body 202, allows flow of glutinous substance 168 through first channel 208 as brush 200 rotates about rotational axis 238. First outlet 280 of first channel 208 of body 202, being offset from rotational axis 238, helps distribute glutinous substance 168 to locations offset from rotational axis 238. First tube 210 facilitates flow of glutinous substance 168 from first outlet 280 of first channel 208 of body 202 to workpiece 170. Tufts 222 promote the spreading and uniform distribution of glutinous substance 168 on workpiece 170.

Referring generally to FIGS. 6A and 6B and particularly to, e.g., FIG. 10A, according to method (300), (block 308) tufts 222 comprise first plurality of tufts 223 and second plurality of tufts 224. Second plurality of tufts 224 comprises first group of tufts 225 and second group of tufts 226. Second plurality of tufts 224 extends from body 202 at locations on body 202 that lie along curvilinear path 251. First plurality of tufts 223 extend from body 202 at locations on body 202 that lie along linear path 245. Glutinous substance 168, in contact with tufts 222 of second plurality of tufts 224, is delivered onto surface 237 of workpiece 170 and onto lateral surface 233 of head 232 of fastener 230. Glutinous substance 168, in contact with tufts 222 of first plurality of tufts 223, is delivered onto end surface 235 of head 232 of fastener 230. The preceding subject matter of this paragraph characterizes example 47 of the present disclosure, wherein example 47 also includes the subject matter according to example 46, above.

Second plurality of tufts 224, extending from body 202 at locations on body 202 that lie along curvilinear path 251, promote application of glutinous substance 168 onto surface 237 of workpiece 170 around head 232 of fastener 230 and onto at least lateral surface 233 of head 232 of fastener 230. Laying first plurality of tufts 223 at locations on body 202 along linear path 245 facilitates application of glutinous substance 168 onto end surface 235 of fastener 230.

Referring generally to FIG. 2 and particularly to, e.g., FIG. 10A, according to method (300), when rotational axis 238 of body 202 of brush 200 is collinear with central axis 239 of fastener 230 and glutinous substance 168, in contact with tufts 222 of brush 200, is being delivered at least onto surface 237 of workpiece 170, (block 310) first tube 210 of brush 200 is positioned such that lateral surface 233 of head 232 of fastener 230 is located between central axis 239 and first tube 210. The preceding subject matter of this paragraph characterizes example 48 of the present disclosure, wherein example 48 also includes the subject matter according to any one of examples 46 or 47, above.

Positioning first tube 210 of brush 200 such that lateral surface 233 of head 232 of fastener 230 is located between central axis 239 and first tube 210 facilitates the delivery of glutinous substance 168 to surface 237 of workpiece 170 around head 232 of fastener 230.

Referring generally to FIG. 2 and particularly to, e.g., FIG. 10A, according to method (300), (block 312) first tube 210 comprises fourth outlet 271. When rotational axis 238 of body 202 of brush 200 is collinear with central axis 239 of fastener 230 and glutinous substance 168, in contact with tufts 222 of brush 200, is being delivered at least onto surface 237 of workpiece 170, fourth outlet 271 of first tube 210 faces surface 237 of workpiece 170. The preceding subject matter of this paragraph characterizes example 49 of the present disclosure, wherein example 49 also includes the subject matter according to example 48, above.

Fourth outlet 271 of first tube 210, facing surface 237 of workpiece 170, promotes flow of glutinous substance 168 from fourth outlet 271 of first tube 210 onto surface 237 of workpiece 170 in direction perpendicular to surface 237 of workpiece 170.

Referring generally to FIG. 2 and particularly to, e.g., FIG. 10A, according to method (300), when rotational axis 238 of body 202 of brush 200 is collinear with central axis 239 of fastener 230 and glutinous substance 168, in contact with tufts 222 of brush 200, is being delivered at least onto surface 237 of workpiece 170, (block 314) fourth outlet 271 of first tube 210 is located, along rotational axis 238, between surface 237 of workpiece 170 and end surface 235 of head 232 of fastener 230. The preceding subject matter of this paragraph characterizes example 50 of the present disclosure, wherein example 50 also includes the subject matter according to example 49, above.

Fourth outlet 271 of first tube 210, being located, along rotational axis 238, between surface 237 of workpiece 170 and end surface 235 of head 232 of fastener 230 helps to promote delivery of glutinous substance 168 from fourth outlet 270 of first tube 210 to surface 237 of workpiece 170.

Referring generally to FIGS. 3, 5, 6A, and 9 and particularly to, e.g., FIG. 10B, according to method (300), (block 316) body 202 of brush 200 further comprises second channel 211, comprising inlet 209 and second outlet 282. Second outlet 282 is offset from rotational axis 238. Brush 200 further comprises second tube 212, communicatively coupled with second outlet 282 of second channel 211 of body 202. Second tube 212 comprises fifth outlet 273. Method 300 further comprises, while rotating brush 200 relative to workpiece 170 about rotational axis 238, causing end-effector 102 to urge glutinous substance 168 through second channel 211 of body 202 of brush 200 from inlet 209 of second channel 211 to second outlet 282 of second channel 211 and through second tube 212, into contact with tufts 222. When rotational axis 238 of body 202 of brush 200 is collinear with central axis 239 of fastener 230 and glutinous substance 168, in contact with tufts 222, is being delivered at least onto lateral surface 233 of fastener 230, second tube 212 is aligned with lateral surface 233 of head 232 of fastener 230 in a direction along rotational axis 238. The preceding subject matter of this paragraph characterizes example 51 of the present disclosure, wherein example 51 also includes the subject matter according to any one of examples 46 to 50, above.

Second outlet 282 of second channel 211 of body 202, being offset from rotational axis 238, helps distribute glutinous substance 168 to locations offset from rotational axis 238. Second tube 212 facilitates flow of glutinous substance 168 from second outlet 282 of second channel 211 of body 202 to workpiece 170. Inlet 209 forming part of both first channel 208 and second channel 211 simplifies distribution of glutinous substance 168 from end-effector 102 to multiple outlets of body 202 offset from rotational axis 238 of body 202, and further facilitates flow of glutinous substance 168 through first channel 208 and second channel 211 as brush 200 rotates about rotational axis 238. Aligning second tube 212 with lateral surface 233 of head 232 of fastener 230 in direction along rotational axis 238 promotes delivery of glutinous substance 168 onto both lateral surface 233 and end surface 235 of head 232 of fastener 230.

Referring generally to FIGS. 3 and 9 and particularly to, e.g., FIG. 10B, according to method (300), (block 318) when rotational axis 238 of body 202 of brush 200 is collinear with central axis 239 of fastener 230 and glutinous substance 168, in contact with tufts 222, is being delivered at least onto lateral surface 233 of fastener 230, fifth outlet 273 of second tube 212 faces intersection of lateral surface 233 of head 232 of fastener 230 and end surface 235 of head 232 of fastener 230. The preceding subject matter of this paragraph characterizes example 52 of the present disclosure, wherein example 52 also includes the subject matter according to example 51, above.

Fifth outlet 273 of second tube 212, facing intersection of lateral surface 233 of head 232 of fastener 230 and end surface 235 of head 232 of fastener 230, facilitates delivery of glutinous substance 168 towards intersection of lateral surface 233 of head 232 of fastener 230 and end surface 235 of head 232 of fastener 230. In one example, delivering glutinous substance 168 towards intersection of lateral surface 233 of head 232 of fastener 230 and end surface 235 of head 232 of fastener 230 results in glutinous substance 168 being applied onto both lateral surface 233 and end surface 235 of head 232 of fastener 230.

Referring generally to FIGS. 3 and 9 and particularly to, e.g., FIG. 10B, according to method (300), when rotational axis 238 of body 202 of brush 200 is collinear with central axis 239 of fastener 230 and glutinous substance 168, in contact with tufts 222, is being delivered at least onto lateral surface 233 of fastener 230, (block 320) a plane co-planar with end surface 235 of head 232 of fastener 230 intersects fifth outlet 273 of second tube 212. The preceding subject matter of this paragraph characterizes example 53 of the present disclosure, wherein example 53 also includes the subject matter according to example 52, above.

Positioning second tube 212 such that a plane co-planar with end surface 235 of head 232 of fastener 230 intersects fifth outlet 273 of second tube 212 promotes delivery of glutinous substance 168 onto both lateral surface 233 and end surface 235 of head 232 of fastener 230.

Referring generally to FIGS. 3 and 9 and particularly to, e.g., FIG. 10B, according to method (300), (block 322) when rotational axis 238 of body 202 of brush 200 is collinear with central axis 239 of fastener 230 and glutinous substance 168, in contact with tufts 222, is being delivered at least onto lateral surface 233 of fastener 230, fifth outlet 273 of second tube 212 is oblique relative to surface 237 of workpiece 170, lateral surface 233 of head 232 of fastener 230, and end surface 235 of head 232 of fastener 230. The preceding subject matter of this paragraph characterizes example 54 of the present disclosure, wherein example 54 also includes the subject matter according to any one of examples 51 to 53, above.

Fifth outlet 273 of second tube 212, being oblique relative to surface 237 of workpiece 170, lateral surface 233 of head 232 of fastener 230, and end surface 235 of head 232 of fastener 230, provides for delivery of glutinous substance 168 onto both lateral surface 233 and end surface 235 of head 232 of fastener 230.

Referring generally to FIGS. 4, 5, 6A, 7, and 8 and particularly to, e.g., FIG. 10C, according to method (300), (block 324) body 202 of brush 200 further comprises third channel 213, comprising inlet 209 and third outlet 284. Third outlet 284 is offset from rotational axis 238. Brush 200 further comprises third tube 214, communicatively coupled with third outlet 284 of third channel 213 of body 202. Third tube 214 comprises sixth outlet 275. Method 300 further comprises, while rotating brush 200 relative to workpiece 170 about rotational axis 238, causing end-effector 102 to urge glutinous substance 168 through third channel 213 of body 202 of brush 200 from inlet 209 of third channel 213 to third outlet 284 of third channel 213 and through third tube 214, into contact with tufts 222. When rotational axis 238 of body 202 of brush 200 is collinear with central axis 239 of fastener 230 and glutinous substance 168, in contact with tufts 222, is being delivered at least onto end surface 235 of fastener 230, third tube 214 of brush 200 is positioned between central axis 239 of fastener 230 and lateral surface 233 of head 232 of fastener 230. The preceding subject matter of this paragraph characterizes example 55 of the present disclosure, wherein example 55 also includes the subject matter according to any one of examples 51 to 54, above.

Third outlet 284 of third channel 213 of body 202, being offset from rotational axis 238, helps distribute glutinous substance 168 to locations offset from rotational axis 238. Third tube 214 facilitates flow of glutinous substance 168 from third outlet 284 of third channel 213 of body 202 to workpiece 170. Inlet 209 forming part of first channel 208, second channel 211, and third channel 213 simplifies distribution of glutinous substance 168 from end-effector 102 to multiple outlets of body 202 offset from rotational axis 238 of body 202, and further facilitates flow of glutinous substance 168 through first channel 208, second channel 211, and third channel 213 as brush 200 rotates about rotational axis 238. Third tube 214 of brush 200, being positioned between central axis 239 of fastener 230 and lateral surface 233 of head 232 of fastener 230, facilitates the delivery of glutinous substance 168 to end surface 235 of head 232 of fastener 230.

Referring generally to FIGS. 4, 7, and 8 and particularly to, e.g., FIG. 10C, according to method (300), (block 326) when rotational axis 238 of body 202 of brush 200 is collinear with central axis 239 of fastener 230 and glutinous substance 168, in contact with tufts 222, is being delivered at least onto end surface 235 of fastener 230, sixth outlet 275 of third tube 214 faces end surface 235 of head 232 of fastener 230. The preceding subject matter of this paragraph characterizes example 56 of the present disclosure, wherein example 56 also includes the subject matter according to example 55, above.

Sixth outlet 275 of third tube 214, facing end surface 235 of head 232 of fastener 230, promotes flow of glutinous substance 168 from sixth outlet 275 of third tube 214 onto end surface 235 of head 232 of fastener 230 in direction perpendicular to end surface 235 of head 232 of fastener 230.

Referring generally to FIGS. 4, 7, and 8 and particularly to, e.g., FIG. 10C, according to method (300), (block 328) when rotational axis 238 of body 202 of brush 200 is collinear with central axis 239 of fastener 230 and glutinous substance 168, in contact with tufts 222, is being delivered at least onto end surface 235 of fastener 230, sixth outlet 273 of third tube 214 is parallel with end surface 235 of head 232 of fastener 230. The preceding subject matter of this paragraph characterizes example 57 of the present disclosure, wherein example 57 also includes the subject matter according to any one of examples 55 or 56, above.

Sixth outlet 275 of third tube 214, being parallel with end surface 235 of head 232 of fastener 230, promotes flow of glutinous substance 168 from sixth outlet 275 of third tube 214 onto end surface 235 of head 232 of fastener 230 in direction perpendicular to end surface 235 of head 232 of fastener 230.

Examples of the present disclosure may be described in the context of aircraft manufacturing and service method 1100 as shown in FIG. 11 and aircraft 1102 as shown in FIG. 12. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 11, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A brush for delivering a glutinous substance to a workpiece from an end-effector, the brush comprising:

a body, having a rotational axis and comprising a first channel that comprises an inlet and a first outlet, wherein the inlet is coaxial with the rotational axis and the first outlet is offset from the rotational axis;

tufts, extending from the body and each comprising a tip and bristles, wherein the tip of each one of the tufts is spaced apart from the tip of any other one of the tufts; and a first tube, communicatively coupled with the first outlet of the first channel of the body; and wherein:

the tufts comprise a second plurality of tufts;

the tufts of the second plurality of tufts extend from the body at locations on the body that lie along a curvilinear path about the rotational axis;

two or more of the tufts of the second plurality of tufts are angled radially inwardly toward or radially outwardly away from the rotational axis;

the second plurality of tufts comprises a first group of tufts and a second group of tufts;

each of the tips of each of the tufts comprises an end face;

the end faces of the first group of tufts are parallel to the rotational axis of the body; and the end faces of the second group of tufts are perpendicular to the rotational axis of the body.

2. The brush according to claim 1, wherein:

one of the tufts is oblique to the rotational axis of the body; and the tip of the one of the tufts is farther away from the rotational axis of the body than any other portion of the first one of the tufts.

3. The brush according to claim 2, wherein:

a second one of the tufts is oblique to the rotational axis of the body; and the tip of the second one of the tufts is closer to the rotational axis of the body than any other portion of the second one of the tufts.

4. The brush according to claim 1, wherein the tips of the first group of tufts are equidistant from the rotational axis of the body.

5. The brush according to claim 1, wherein the tip of each tuft of the first group of tufts is differently spaced from a virtual plane that is perpendicular to the rotational axis of the body than the tip of any other tuft of the first group of tufts.

6. The brush according to claim 1, wherein the tips of the second group of tufts are equidistant from a virtual plane that is perpendicular to the rotational axis of the body.

7. The brush according to claim 1, wherein the tip of each tuft of the second group of tufts is differently spaced from the rotational axis of the body than the tip of any other tuft of the second group of tufts.

8. The brush according to claim 1, wherein the curvilinear path, along which the second plurality of tufts extends from the body, is a radially non-overlapping spiral path.

9. The brush according to claim 1, wherein the curvilinear path, along which the second plurality of tufts extends from the body, is a circular path.

10. The brush according to claim 9, wherein the locations on the body that lie along the circular path are equidistant from the rotational axis of the body.

11. The brush according to claim 1, wherein:

the tufts further comprise a first plurality of tufts, and the tufts of the first plurality of tufts extend from the body at locations on the body that lie along a linear path.

12. The brush according to claim 11, wherein the end face of at least one of the tips of the first plurality of tufts is oblique to the rotational axis of the body.

13. The brush according to claim 12, wherein the end faces of at least two of the tips of the first plurality of tufts are oblique to each other.

14. The brush according to claim 1, wherein:

the body further comprises a second channel, comprising the inlet and a second outlet;

the second outlet is offset from the rotational axis; and the brush further comprises a second tube, communicatively coupled with the second outlet of the second channel of the body.

15. The brush according to claim 14, wherein:

the body further comprises a third channel, comprising the inlet and a third outlet;

the third outlet is offset from the rotational axis; and the brush further comprises a third tube, communicatively coupled with the third outlet of the third channel of the body.

16. The brush according to claim 15, wherein:

the first tube extends along the rotational axis of the body a greater distance away from the body than the second tube; and the second tube extends along the rotational axis of the body a greater distance away from the body than the third tube.

17. The brush according to claim 15, wherein:

the first tube is located on the body a greater distance away from the rotational axis than the second tube; and the second tube is located on the body a greater distance away from the rotational axis than the third tube.

18. The brush according to claim 1, wherein the first tube is more flexible than the body of the brush.

19. The brush according to claim 1, wherein the first channel is cross-sectionally circumferentially closed.

20. The brush according to claim 1, wherein the first tube extends from the body a shorter distance than at least one of the tufts along the rotational axis of the body.

21. The brush according to claim 1, wherein the first tube is parallel to the rotational axis of the body.

22. The brush according to claim 1, wherein the first tube is oblique to the rotational axis of the body.

23. The brush according to claim 1, wherein at least two of the tufts are oblique to each other.

24. The brush according to claim 1, wherein at least one of the tufts is parallel to the rotational axis of the body and at least another one of the tufts is oblique to the rotational axis of the body.

25. The brush according to claim 11, wherein the linear path does not intersect the rotational axis of the body.

26. The brush according to claim 11, wherein the linear path intersects the rotational axis of the body.

27. The brush according to claim 11, wherein each of the first plurality of tufts is oblique to the rotational axis of the body.

28. The brush according to claim 11, wherein each of the first plurality of tufts is parallel to the rotational axis of the body.

29. The brush according to claim 11, wherein at least two of the first plurality of tufts have different lengths.

30. The brush according to claim 1, wherein angular orientations of at least two of the tufts relative to a virtual plane perpendicular to the rotational axis of the body are different.

31. The brush according to claim 1, wherein angular orientations of at least two of the tufts relative to a virtual plane perpendicular to the rotational axis of the body are identical.

32. The brush according to claim 1, wherein lengths of at least two of the tufts, extending from the body, are different.

33. The brush according to claim 14, wherein the second tube is more flexible than the body of the brush.

34. The brush according to claim 14, wherein the second channel is cross-sectionally circumferentially closed.

35. The brush according to claim 14, wherein the second tube extends from the body a shorter distance than at least one of the tufts along the rotational axis of the body.

36. The brush according to claim 14, wherein the second tube is parallel to the rotational axis of the body.

37. The brush according to claim 15, wherein the third tube is more flexible than the body of the brush.

38. The brush according to claim 15, wherein the third channel is cross-sectionally circumferentially closed.

39. The brush according to claim 15, wherein the third tube extends from the body a shorter distance than at least one of the tufts along the rotational axis of the body.

40. The brush according to claim 15, wherein the third tube is parallel to the rotational axis of the body.

41. The brush according to claim 15, wherein:

the first tube comprises a first central axis and a fourth outlet; and the fourth outlet of the first tube is perpendicular to the first central axis of the first tube.

42. The brush according to claim 15, wherein:

the second tube comprises a second central axis and a fifth outlet; and the fifth outlet of the second tube is oblique to the second central axis of the second tube.

43. The brush according to claim 15, wherein:

the third tube comprises a third central axis and a sixth outlet; and the sixth outlet of the third tube is perpendicular to the third central axis of the third tube.

44. The brush according to claim 1, wherein each one of the tufts of the second plurality of tufts is angled radially inwardly or outwardly relative to an adjacent one of the tufts of the second plurality of tufts.

45. The brush according to claim 1, wherein an angle, defined radially between each one of the tufts of the second plurality of tufts and the rotational axis, changes, from one of the tufts to an adjacent one of the tufts along the curvilinear path, for all the tufts of the second plurality of tufts.

46. The brush according to claim 14, wherein:

the first tube is parallel to the rotational axis; and the second tube is inclined relative to the rotational axis.

47. The brush according to claim 11, wherein:

the linear path intersects the rotational axis of the body;

all the tufts of the first plurality of tufts are not parallel to the rotational axis and are identically inclined relative to the rotational axis; and at least two of the tufts of the first plurality of tufts are inclined radially inwardly toward the rotational axis.

48. A brush for delivering a glutinous substance to a workpiece from an end-effector, the brush comprising:

a body, having a rotational axis and comprising a first channel that comprises an inlet and a first outlet, wherein the inlet is coaxial with the rotational axis and the first outlet is offset from the rotational axis;

tufts, extending from the body and each comprising a tip and bristles, wherein the tip of each one of the tufts is spaced apart from the tip of any other one of the tufts; and a first tube, communicatively coupled with the first outlet of the first channel of the body; and wherein:

the tufts comprise a second plurality of tufts;

the tufts of the second plurality of tufts extend from the body at locations on the body that lie along a curvilinear path about the rotational axis;

two or more of the tufts of the second plurality of tufts are angled radially inwardly toward or radially outwardly away from the rotational axis;

a first one of the tufts is oblique to the rotational axis of the body;

the tip of the first one of the tufts is farther away from the rotational axis of the body than any other portion of the first one of the tufts;

a second one of the tufts is oblique to the rotational axis of the body; and the tip of the second one of the tufts is closer to the rotational axis of the body than any other portion of the second one of the tufts.

49. The brush according to claim 48, wherein:

the body further comprises a second channel, comprising the inlet and a second outlet;

the second outlet is offset from the rotational axis; and the brush further comprises a second tube, communicatively coupled with the second outlet of the second channel of the body.

50. The brush according to claim 49, wherein:

the body further comprises a third channel, comprising the inlet and a third outlet;

the third outlet is offset from the rotational axis; and the brush further comprises a third tube, communicatively coupled with the third outlet of the third channel of the body.

51. The brush according to claim 50, wherein:

the first tube extends along the rotational axis of the body a greater distance away from the body than the second tube; and the second tube extends along the rotational axis of the body a greater distance away from the body than the third tube.

52. The brush according to claim 50, wherein:

the first tube is located on the body a greater distance away from the rotational axis than the second tube; and the second tube is located on the body a greater distance away from the rotational axis than the third tube.

* * * * *